US006801747B2

(12) United States Patent
Ogara et al.

(10) Patent No.: US 6,801,747 B2
(45) Date of Patent: Oct. 5, 2004

(54) CLEANING APPARATUS AND IMAGE FORMING APPARATUS

(75) Inventors: Keizo Ogara, Toride (JP); Jun Asai, Nagareyama (JP); Koki Watanabe, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/201,990

(22) Filed: Jul. 25, 2002

(65) Prior Publication Data

US 2003/0021618 A1 Jan. 30, 2003

(30) Foreign Application Priority Data

| | | |
|---|---|---|
| Jul. 26, 2001 | (JP) | 2001-225538 |
| Jul. 26, 2001 | (JP) | 2001-225539 |
| Jul. 26, 2001 | (JP) | 2001-225540 |
| Jul. 26, 2001 | (JP) | 2001-225543 |
| Jul. 26, 2001 | (JP) | 2001-225544 |
| Jul. 26, 2001 | (JP) | 2001-225545 |

(51) Int. Cl.[7] ..... G03G 21/00
(52) U.S. Cl. ..... 399/350; 15/256.51; 399/351
(58) Field of Search ..... 399/67, 69, 71, 399/343, 345, 350, 351; 15/256.1, 256.51, 256.52

(56) References Cited

U.S. PATENT DOCUMENTS

| | | | | |
|---|---|---|---|---|
| 4,111,545 A | | 9/1978 | Meltzer | 399/351 |
| 4,145,137 A | | 3/1979 | Sunaga et al. | 399/351 |
| 4,875,070 A | * | 10/1989 | Hattori | 399/350 |
| 4,982,240 A | * | 1/1991 | Nakano | 399/358 |
| 5,138,394 A | | 8/1992 | Watanabe et al. | 399/360 |
| 5,710,966 A | * | 1/1998 | Otsuka et al. | 399/343 |
| 5,842,102 A | | 11/1998 | Montfort et al. | 399/349 |
| 6,018,140 A | * | 1/2000 | Hirose et al. | 399/69 X |
| 6,128,461 A | | 10/2000 | Yoshikawa | 399/350 |

FOREIGN PATENT DOCUMENTS

| | | |
|---|---|---|
| JP | 5-188832 | * 7/1993 |
| JP | 6-4014 | 1/1994 |
| JP | 9-160455 | 6/1997 |
| JP | 11-174922 | 7/1999 |
| JP | 2000-112187 | 4/2000 |

OTHER PUBLICATIONS

Patent Abstracts of Japan, Publication No. 9–160455, Publication Date Jun. 20, 1997.

Patent Abstracts of Japan, Publication No. 2000–112187, Publication Date Apr. 21, 2000.

* cited by examiner

*Primary Examiner*—Hoan Tran
(74) *Attorney, Agent, or Firm*—Fitzpatrick, Cella, Harper & Scinto

(57) ABSTRACT

A cleaning device includes a cleaning member for cleaning a surface of an image bearing member while it is moving, a holding member for holding the cleaning member, a vibrating member which per se is vibratable, and a controller for controlling operation of the vibrating member. The holding member is movable toward and away from the image bearing member, the vibrating member is held on the holding member, and the controller actuates the vibrating member upon stoppage of movement of the image bearing member.

19 Claims, 22 Drawing Sheets

CLEANING APPARATUS AND IMAGE FORMING APPARATUS

FIELD OF THE INVENTION AND RELATED ART

The present invention relates to a cleaning apparatus for cleaning the surface of an image bearing member in a printer, a copying machine, a facsimile machine, and the like. It also relates to an image forming apparatus equipped with a cleaning apparatus.

In the field of a cleaning apparatus for an image forming apparatus such as a printer, a copying machine, a facsimile machine, and the like, a cleaning apparatus having a cleaning blade as a cleaning member for cleaning an image bearing member has been known.

In an electrophotographic image forming apparatus, for example, a toner image is formed on a photoconductive drum (image bearing member) through a plurality of image forming processes: a charging process, an exposing process, and a developing process. The toner image is transferred onto transfer medium (for example, paper) from the photoconductive drum through a transferring process. During this transferring process, all the toner, of which the toner image on the photoconductive drum is formed, is not transferred; a small amount of the toner remains on the peripheral surface of the photoconductive drum The toner remaining on the peripheral surface of the photoconductive drum (which hereinafter will be referred to as "residual toner") is removed by the above described cleaning blade.

Referring to FIG. 9, the edge 61*a* of a cleaning blade 61 is placed in contact with the peripheral surface of a photoconductive drum 11, so that the residual toner adhering to the peripheral surface of the photoconductive drum 11 is scraped away by the cleaning blade 61.

However, a cleaning blade in accordance with the prior art, such as the above described one, suffers from the following problems.

Also referring to FIG. 9, as the residual toner is scraped away by the edge 61*a* of the cleaning blade 61 placed in contact with the peripheral surface of the photoconductive drum 11, it agglomerates in the adjacencies of the edge 61*a*. Normally, as the agglomeration of the residual toner grows to a certain size, it falls off into the cleaning apparatus shell (unshown) of the cleaning apparatus, creating no problem.

In recent years, however, it became evident that, due to the increase in the peripheral velocity (process speed) of the photoconductive drum 11 resulting from the increase in the speed of an image forming apparatus, the agglomeration of the toner kept on growing in size without falling, and that some of the toner particles slipped through the nip N between the edge 61*a* of the cleaning blade 61 and the photoconductive drum 11, and transferred onto a transfer medium (in the form of a sheet), forming stripes across the medium, during the following image formation cycle. This has been a serious problem. Incidentally, the severity of this problematic phenomenon also depends on the ambient conditions.

As for a method for improving the cleaning performance of a cleaning blade, a few have been disclosed. For example, Japanese Laid-open Patent Application Nos. 6-4014 and 11-174922 disclose a method which causes a cleaning blade to vibrate with the use of a piezoelectric element. This method, however, suffers from the following faults. That is, a piezoelectric element is attached to a cleaning blade, which deteriorates as its cumulative usage increases, and therefore, must be replaced. As the deteriorated cleaning blade is replaced with a fresh one, the piezoelectric element is replaced together with the deteriorated cleaning blade, resulting in cost increase, since the piezoelectric element is attached to the deteriorated cleaning blade. Further, it is difficult to vibrate sufficiently to remove the grown agglomeration of the residual toner. Japanese Laid-open Patent Application No. 9-160455 discloses a method which uses an impact to vibrate a cleaning blade. This method, however, suffers from the following problem: a certain behavior of a cleaning blade which occurs as the cleaning blade is vibrated by impact may allow the residual toner to slip through the nip N, although it may be possible to vibrate vigorously enough to remove the grown agglomeration of the residual toner.

According to Japanese Laid-open Patent Application No. 2000-112187, when a number of copies to be made is greater than a predetermined number, the rotation of the photoconductive drum is temporarily interrupted for every predetermined number of copies, so that the shape of a cleaning blade slightly changes, changing therefore the shape of the nip portion N, while the rotating photoconductive drum comes to a complete stop, and so that the change in the shape of the nip portion N causes the residual toner solidifying in the nip portion N to fall. This method can remove the residual toner only when the agglomerated residual toner is smaller in size; it cannot be said to be perfect.

Obviously, a machine with a high processing speed is required to have a long service life Therefore, it requires a method capable of satisfactorily removing the above described agglomerated toner on the photoconductive drum, for a long period of time, in order to maintain image quality at or above a predetermined level. Further, it is believed that in order to prevent the increase in the operational load and cost incurred when replacing a vibration generating means to maintain image quality at a predetermined level or higher, it is very important for the length of the service life of a vibration generating means to balance that of a cleaning apparatus or an image forming apparatus.

SUMMARY OF THE INVENTION

The present invention was made in consideration of the above described circumstances, and a primary object of the present invention is to provide a cleaning apparatus capable of satisfactorily removing the residual toner having agglomerated in the adjacencies of the cleaning blade, and an image forming apparatus equipped with such a cleaning apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings. In these drawings, those having the same referential code are the same in structure or operation, and their descriptions will be discretionarily omitted to eliminate repetition.

Embodiment 1

First, an image forming apparatus equipped with a cleaning apparatus in accordance with this first embodiment of the present invention will be described in detail with reference to drawings.

Image Forming Apparatus

Figure 1:
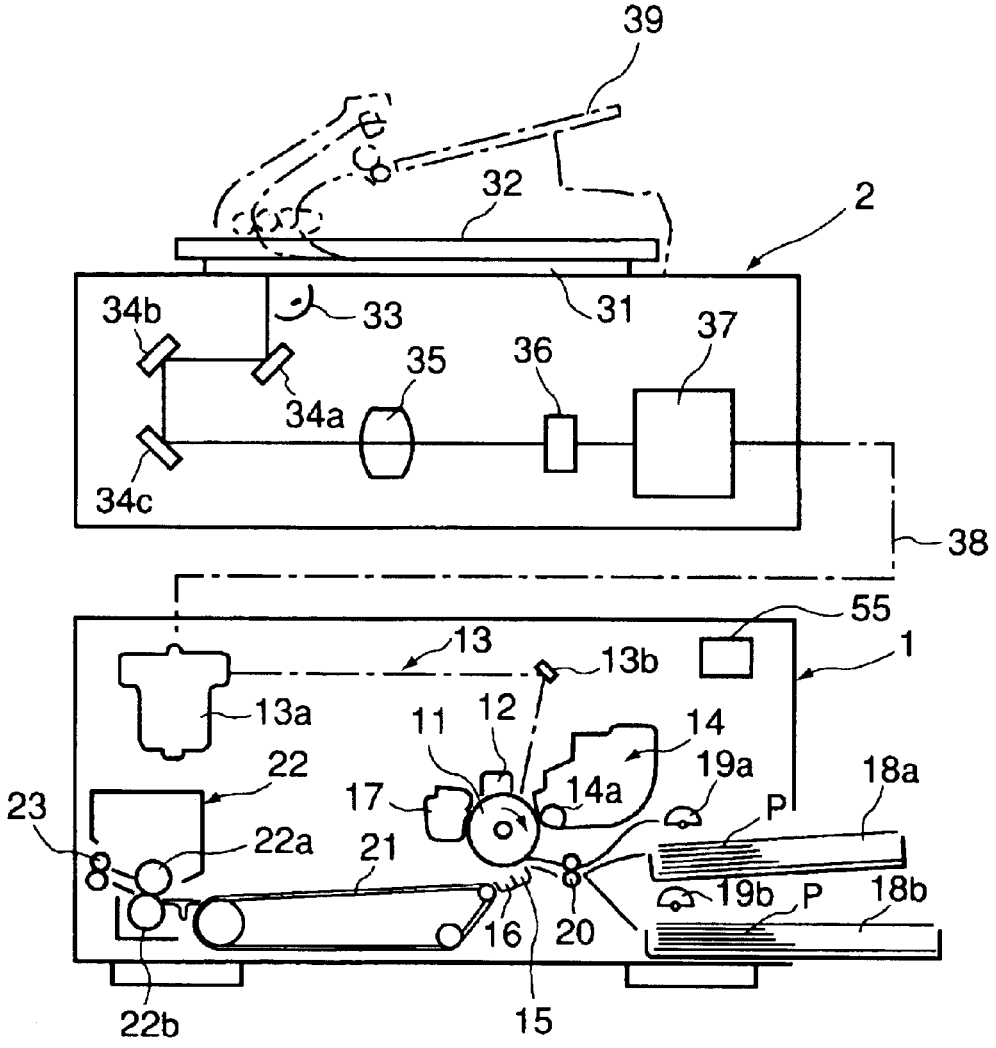
FIG. 1 is a vertical sectional view of an image forming apparatus in accordance with the present invention, for showing the general structure thereof

FIG. 1 shows an example of an image forming apparatus in accordance with the present invention. The image forming apparatus shown in the drawing is a laser beam printer, and the drawing is a vertical sectional view of the image forming apparatus, for showing the general structure thereof. In the following description of the first embodiment of the present invention, the present invention will be described with reference to a case in which the object to be cleaned by a cleaning apparatus 17 (which will be described later) in accordance with the present invention is a photoconductive drum 11.

The laser beam printer shown in the drawing (which hereinafter will be referred to as an "image forming apparatus") comprises a printing portion 1 (image forming portion) and a reading portion 2 (image reading portion).

Of the two portions, the printing portion 1 comprises an electrophotographic photoconductive member 11, as an image bearing member, in the form of a drum (which hereinafter will be referred to as a "photoconductive drum"), which is disposed within the printing portion 1 The printing portion 1 also comprises a primary charging device 12 (primary charging means), an exposing apparatus 13 (exposing means), a developing device 14 (developing means), a transfer charging device 15, a separation charging device 16, and a cleaning apparatus 17 (cleaning means), which are disposed around the photoconductive drum 11 in the listed order in terms of the rotational direction (direction indicated by an arrow mark) of the photoconductive drum 11. There are also sheet feeding cassettes 18*a* and 18*b*, sheet feeding rollers 19*a* and 19*b*, a registration roller 20, a conveyer belt 21, a fixing device 22 (fixing means) having a fixing roller 22*a* and pressing roller 22*b*, and a pair of discharging rollers 23, which are disposed in the listed order in terms of the direction in which a transfer medium P (paper, for example) is conveyed.

In comparison, the reader portion 2 comprises a platen glass 31, an original pressing plate 32, a light source 33, deflective mirrors 34*a*, 34*b*, and 34*c*, a lens 35, a CCD 36 (photoelectric transducer), an image processing portion 37, and the like.

In the printer portion 1 of the image forming apparatus structured as described above, the photoconductive drum 11 is rotationally driven by a driving means (unshown) in the direction indicated by an arrow mark at a predetermined process speed (peripheral velocity), which in this embodiment is 480 mm/sec, and the peripheral surface of the photoconductive drum 11 is uniformly charged to predetermined polarity and potential level by the primary charging device 12. Meanwhile, in the reading portion 2, the image bearing surface (bottom surface) of an original (unshown) kept pressed upon the platen glass 31 by the original pressing plate 32 is illuminated by the light from the light source 33, reflecting the light. The light reflected by the image bearing surface is deflected by the deflective mirrors 34*a*, 34*b*, and 34*c*, and is projected onto the CCD 36 by the lens 35, being transduced into electrical signals 38 The thus generated electrical signals 38 are subjected to various known image formation processes by the image processing portion 37, and then, are inputted, as image formation data, into the exposing apparatus 13 of the printer portion 1.

The laser scanner 13*a* of the exposing apparatus 13 projects a beam of laser light while modulating it with the aforementioned image formation data. Then, the beam of laser light is deflected by the deflective mirror 13*b*, and exposes the peripheral surface of the photoconductive drum 11, which has been charged as described above. Through this exposure, an electrostatic latent image is formed on the peripheral surface of the photoconductive drum 11.

The electrostatic latent image is developed by the developing device 14. More specifically, the developing device 14 contains developer (toner), and as development bias is applied to the development sleeve 14*a* of the developing device 14, the toner is electrostatically adhered to the peripheral surface of the photoconductive drum 11 in a pattern reflecting the electrostatic latent image; the electrostatic latent image is developed into a toner image.

After being formed on the peripheral surface of the photoconductive drum 11 through the above described processes, the toner image is transferred onto the transfer medium P. The transfer medium P is fed into the image forming apparatus from the sheet feeding cassette 18*a* or 18*b* by a sheet feeding roller 19*a* or 19*b*, respectively, and is delivered to the transfer station between the photoconductive drum 11 and transfer charging device 15, with the timing controlled by the registration roller 20 so that the leading end of the toner image on the photoconductive drum 11 and the print starting line of the transfer medium P simultaneously arrive at the transfer portion, in which the toner image on the photoconductive drum 11 is transferred onto the transfer medium P as transfer bias is applied to the transfer charging device 15.

After the transfer of the toner image, the transfer medium P is separated from the peripheral surface of the photoconductive drum 11 by the separation charging device 16, and is conveyed by the conveyer belt 21 to the fixing device 22, in which the toner image is fixed to the surface of the transfer medium P by the heat and pressure applied by the fixing roller 22*a* and pressing roller 22*b*. Thereafter, the transfer medium P is discharged from the image forming apparatus main assembly by the pair of discharger rollers 23.

Meanwhile, the residual toner particles (residue), that is, the toner particles which were not transferred onto the transfer medium P in the transfer station, and remained on the peripheral surface of the photoconductive drum 11, are removed by the cleaning apparatus 17 to prepare the peripheral surface of the photoconductive drum 11 for the following image formation. The cleaning apparatus 17 will be described later in detail.

Incidentally, FIG. 1 outlines, with the use of double-dot chain lines, an automatic original feeding apparatus 39, which is located above the original pressing plate 32 and is capable of automatically feeding a single or plurality of originals onto the platen glass 31 and automatically removing the single or plurality of originals from the platen glass 31.

Cleaning Apparatus

Figure 2:
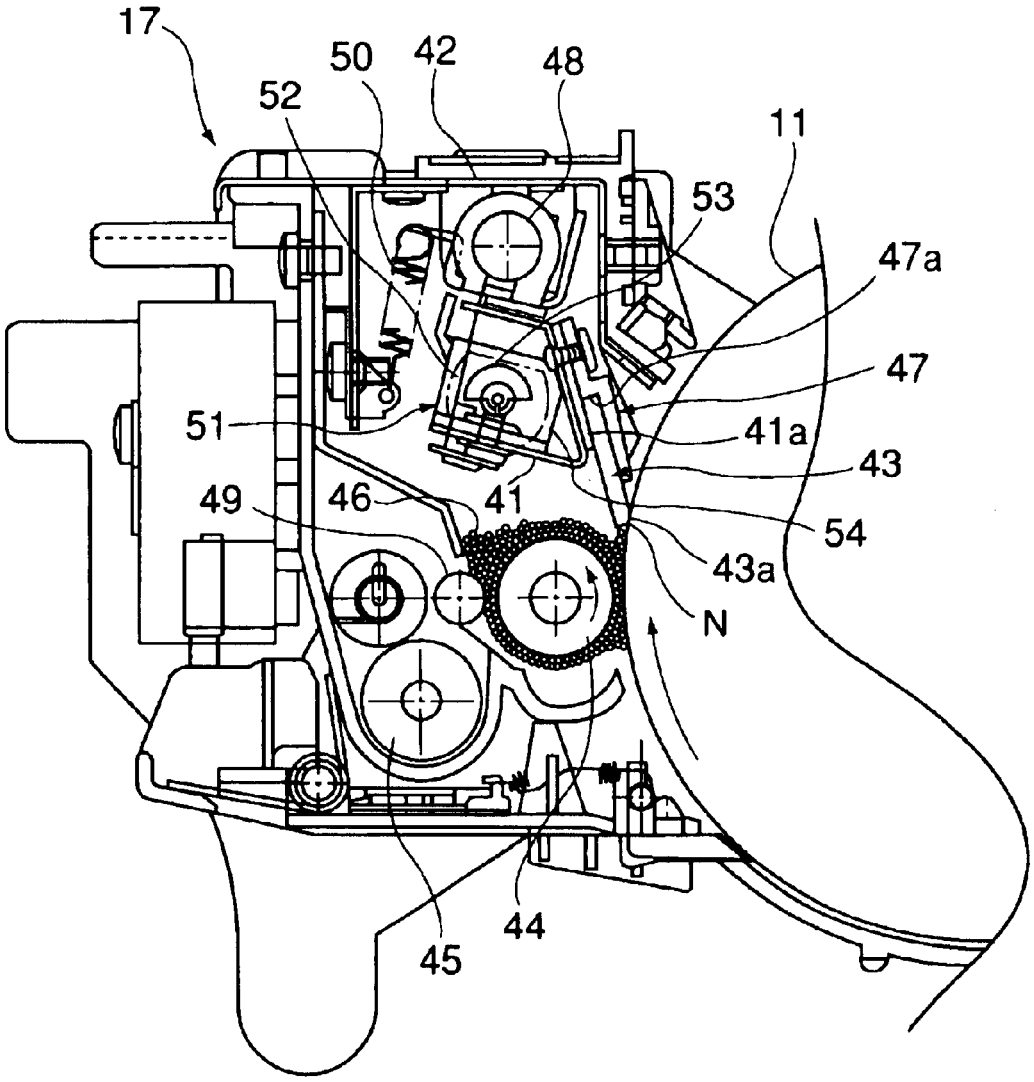
FIG. 2 is a vertical sectional view of a cleaning apparatus in accordance with the present invention, for showing the general structure thereof.

Next, referring to FIG. 2, the cleaning apparatus 17 in accordance with the present invention will be described in detail. FIG. 2 is a vertical sectional view of the cleaning apparatus 17, at a plane perpendicular to the lengthwise direction (axial direction) of the photoconductive drum 11.

The cleaning apparatus 17 has a frame 41 (first frame), a frame 42 (second frame), a cleaning blade 43 (cleaning member), a magnetic roller 44, a conveying screw 45, a sheet 46, a holder 47, shafts 48 and 49, a tension spring 50 (pressure applying means), and a vibration generating means 51.

Of those components, the cleaning blade 43 is formed of a plate of elastic substance, for example, urethane rubber. It is held to the frame 41 by the holder 47, being sandwiched between the frame 41 and the holder 47 screwed to the frame 41. The cleaning blade 43 is placed in contact with the peripheral surface of the photoconductive drum 11 by the edge 43*a*, that is, one of the two long edges thereof. The contact direction of the cleaning blade 43, or the angle at which the cleaning blade 43 is placed in contact with the peripheral surface of the photoconductive drum 11, is counter to the moving direction (direction indicated by arrow mark) of the peripheral surface of the photoconductive drum 11. The area 41*a* (contact surface) of the frame 41, with which the back surface of the cleaning blade 43 is placed in contact, and the area 47*a* (contact surface) of the holder 47, which is placed in contact with the cleaning blade 43 to keep the cleaning blade 43 held to the frame 41, are highly precisely processed and highly accurately positioned, making it possible for the cleaning blade 43 to be highly accurately positioned relative to the photoconductive drum 11 as it is held to the frame 41 by the holder 47, being partially placed in contact with the above described contact surfaces 41*a* and 47*a*. The frame 41, to which the cleaning blade 43 is held, holds the vibration generating means 51 as well.

The frame 41 is attached to the frame 42 with the use of the shaft 48, being enabled to rotate about the shaft 48 in the direction to move away from the photoconductive drum 11. In this embodiment, the frame 41 is enabled to move away from the photoconductive drum 11 in the direction perpendicular to the lengthwise direction of the photoconductive drum 11. However, the cleaning apparatus may be structured so that the frame 41 is enabled to move away from the photoconductive drum 11 in a direction different from the direction perpendicular to the lengthwise direction of the photoconductive drum 11. One end of the above described tension spring 50 is connected to a part of the frame 42, and the other end is attached to a part of the frame 41. Thus, the frame 41 is kept pressured by this tension spring 50 to rotate about the shaft 48 in the counterclockwise direction of the drawing, generating thereby a predetermined amount of pressure between the edge 43*a* of the cleaning blade 43 and the peripheral surface of the photoconductive drum 11, while keeping the former in contact with the latter.

The frame 42 is made up of the top portion and two lateral portions. The lateral portion farther from the photoconductive drum 11 extends downward, and its bottom portion diagonally extends toward the photoconductive drum 11. The aforementioned magnetic roller 44 and conveying screw 45 are rotationally held by this lateral portion of the frame 42. The magnetic roller 44 and conveying screw 45 are rotationally driven by a driving means (unshown).

The magnetic roller 44 is disposed below the cleaning blade 43, bearing, on its peripheral surface, a layer of the residual toner particles having been scraped down from the peripheral surface of the photoconductive drum 11 by the cleaning blade 43. The thickness of this toner particles layer is regulated by the sheet 46 and shaft 49. The magnetic roller 44 is disposed in parallel to the lengthwise direction (generatrix direction) of the photoconductive drum 11, with the provision of a predetermined amount of gap between itself and the peripheral surface of the photoconductive drum 11, so that some of the residual toner particles in the residual toner particles layer on the magnetic roller 44 are coated again on the peripheral surface of the photoconductive drum 11, after landing on the magnetic roller 44 as they are removed from the peripheral surface of the photoconductive drum 11. This is for preventing the following problem which occurs when the residual toner particles are scraped down by the cleaning blade 43 without being coated again onto the photoconductive drum 11, that is, the problem that the difference in friction between the portion of the cleaning blade edge 43*a* in contact with the portion of the peripheral surface of the photoconductive drum 11 covered with the residual toner particles, and the portion of the cleaning blade edge 43 in contact with the portion of the peripheral surface of the photoconductive drum 11 free of the residual toner particles, causes the cleaning blade 34 to slightly vibrate (which is unnecessary). In other words, coating the peripheral surface of the photoconductive drum 11 with the removed residual toner particles, uniformly in terms of the lengthwise direction of the photoconductive drum 11, makes uniform the friction between the cleaning blade 43 and photoconductive drum 11, across the entire contact range, in terms of the lengthwise direction of the photoconductive drum 11, preventing thereby the occurrence of the slight vibration of the cleaning blade 43 traceable to the above described frictional nonuniformity. As the removed residual toner particles are coated onto the peripheral surface of the photoconductive drum 11, they are immediately scraped down, and are recovered by the magnetic roller 44.

Referring to FIG. 2, the rotational direction of the magnetic roller 44 is desired to be the same as that of the photoconductive drum 11. However, the same effects as the above described can be realized even if the rotational direction of the magnetic roller 44 is reverse to that of the photoconductive drum 11.

The sheet 46 is placed in contact with the shaft 49, and is given the function of directing the excessive amount of the removed residual toner particles, that is, the portion unnecessary for the formation of the toner layer on the magnetic roller 44, toward the conveying screw 44, which conveys the excessive amount of the removed residual toner into an unshown recovered toner container.

Vibration Generating Means

Figure 4:
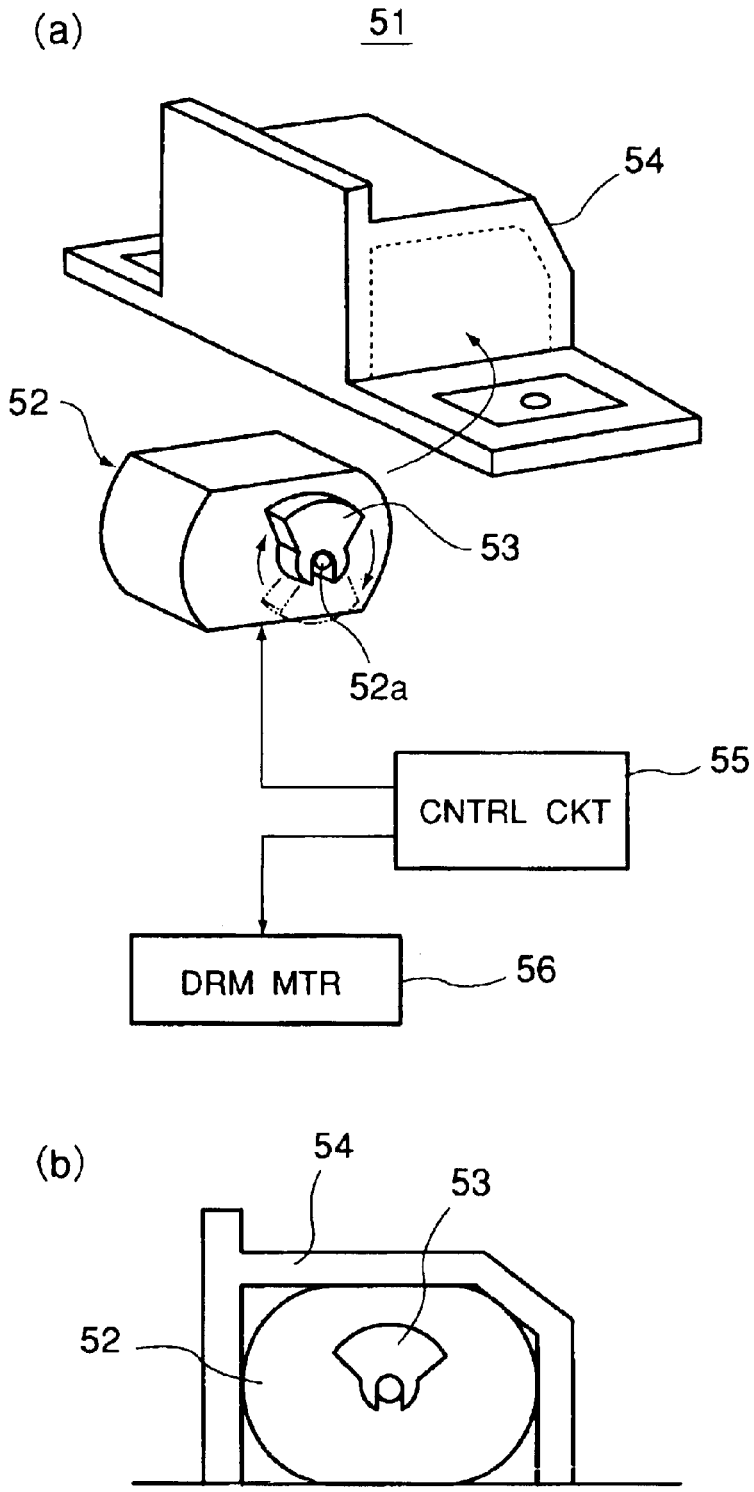
FIGS. 4(*a*) and 4(*b*) are schematic drawings of a combination of a motor and a case, which makes up a vibration generating means.

FIG. 4 shows the structure of the vibration generating means 51 in this embodiment.

The vibration generating means 51 has a motor 52, a plummet 53 (weight) attached to the output shaft 52*a* of the motor 52, and a case 54. The motor 52 is securely encased in the case 54, being connected to a control circuit 55 as a controlling means, as shown in FIG. 4(*b*). The case 54, in which the motor 52 is secured, is solidly fixed to the frame 51 as shown in FIG. 2. The weight 53 is fixed to the output shaft 52*a* so that the center of gravity of the output shaft 52 becomes offset from the axial line of the output shaft 52*a*. Thus, as the output shaft 52*a* of the motor 52 is rotationally driven by the control circuit 55, the motor 52 vibrates. These vibrations propagate through the case 54 and frame 41, and reach the cleaning blade 43. The case 54 is given the function of preventing toner particles from entering the motor 52, and also the function of restraining the motor 52 to make the vibrations efficiently propagate to the frame 41. The control circuit 55 is also connected to the drum motor 56 for rotationally driving the photoconductive drum 11, to control the rotation of the photoconductive drum 11.

The structure of the vibration generating means 51 does not need to be limited to the above described one, as long as the cleaning blade 43 can be vibrated enough to remove the agglomeration of toner particles from the cleaning blade 43.

Figure 5:
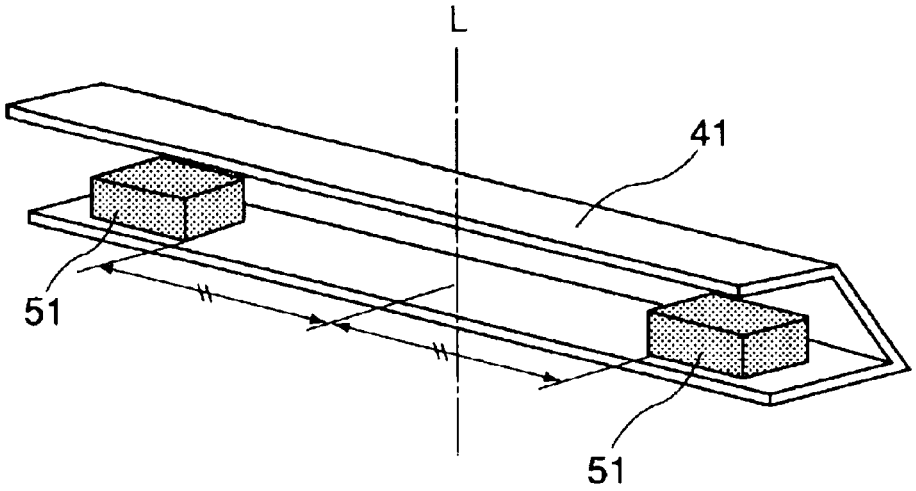
FIG. 5 is a perspective view of a combination of a frame and two vibration generating means attached to the frame.

As for the number and positioning of the vibration generating means 51, attaching a single vibration generating means 51 to the center of the frame 41 of the cleaning apparatus 17, in terms of the lengthwise direction of the frame 41, is effective to some extent. In the case of such a placement of the single vibration generating means 51, however, the vibrations must be relatively large in amplitude for them to propagate to the ends of the cleaning blade 43 to effectively remove the toner particle agglomeration. Thus, a plurality of vibration generating means 51 may be attached to the different portions of the frame 41 so that vibrations can be evenly propagated throughout the cleaning blade 43 while keeping their amplitudes relative small. For example, the two vibration generating means 51 may be attached to the lengthwise end portions of the frame 41 one for one as shown in FIG. 5. In this case, the plurality of vibration generating means 51 should be distributed toward the lengthwise end portions of the frame 41 while balancing the two sides of the frame 41 with reference to the lengthwise center L of the frame 41, so that the unevenness in the contact pressure applied to the photoconductive drum 11 by the cleaning blade 43 is minimized.

Edge Portion of Cleaning Blade

Figure 3:
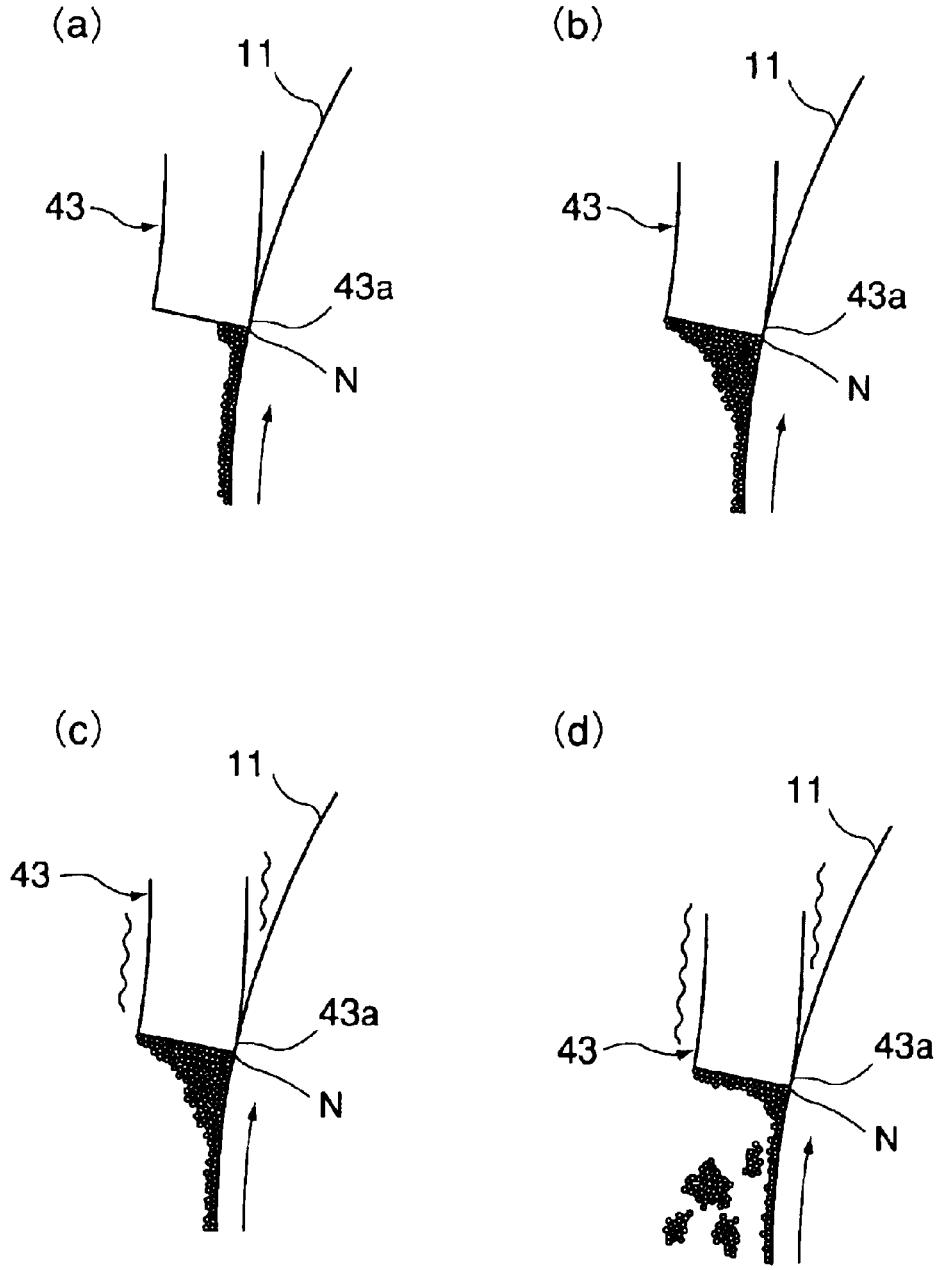
FIGS. 3(*a*)–3(*d*) are enlarged schematic views of the edge of a cleaning blade and the peripheral surface of a photoconductive drum, for showing how the toner particles having agglomerated in the adjacencies of the edge are removed by vibration.

FIGS. 3(*a*), 3(*b*), 3(*c*), and 3(*d*) are enlarged views of the contact portion N (nip) between the peripheral surface of the photoconductive drum 11 and the edge 43*a* of the cleaning blade 43, in this embodiment. Referring to FIG. 3(*a*), the edge 43*a* of the cleaning blade 43 in contact with the photoconductive drum 11 collects the residual toner particles it scrapes away from the peripheral surface of the photoconductive drum 11; the removed residual toner particles agglomerate at the edge 43*a*. Referring to FIG. 3(*b*), as the agglomeration of the removed residual toner particles grows, there arises a possibility that some of the residual toner particles will pass the nip N between the edge 43*a* of the cleaning blade 43 and the peripheral surface of the photoconductive drum 11 and adhere to the transfer medium P, resulting in the formation of a defective image. Therefore, the agglomeration of the removed residual toner particles must be removed from the edge 43*a* of the cleaning blade 43 as it grows.

Thus, the vibration generating means 51 (FIG. 2) is activated to propagate vibrations to the cleaning blade 43 through the frame 41 (FIG. 3(*c*)), so that the agglomeration of the removed residual toner particles is removed from the edge 43*a* of the cleaning blade 43 to prevent the formation of a defective image (FIG. 3(*d*)). As the vibration generating means 51 is activated, the vibrations therefrom also propagate to the photoconductive drum 11 through the cleaning blade 43 Therefore, the activation of the vibration generating means 51 is not desirable while an image is actually formed. If the vibration generating means 51 is activated during the rotation of the photoconductive drum 11, the edge 43*a* of the cleaning blade 43 is partially separated from the photoconductive drum 11 by the vibrations, allowing sometimes the residual toner particles on the photoconductive drum 11 to pass the cleaning blade 43 and manifest as image defects. Therefore, the timing for the activation of the vibration generating means 51 is desired to be such that the vibration generating means 51 is activated only when the photoconductive drum 11 is absolutely still.

When an image forming apparatus stops at the end of an image forming operation, the photoconductive drum 11 continues to rotate for a while due to inertia before it comes to a complete stop. In other words, it takes a certain length of time from the time when the signal for stopping the photoconductive drum 11 is issued to when the photoconductive drum 11 comes to a complete stop.

Thus, the operational timing for the vibration generating means 51 in this embodiment will be described next.

Operational Timing (Sequence) for Vibration Generating Means

Next, referring to FIG. 6, the operational timing for the vibration generating means 51 will be described.

When the apparatus main assembly is turned on for the first time for the day, for example, early in the morning, the temperature of the fixing device is not at a predetermined level. Thus, it is common practice that in order to raise the temperature of the fixing device to the predetermined level, first, the fixing roller and pressing roller are heated without being rotated, and thereafter, the idle rotation of both rollers is started. It is also common practice that the rotation of the photoconductive drum 11 is started at the same time as the idle rotation of both rollers is started.

With the provision of the above described rotational setup, activating the vibration generating means 51 after the photoconductive drum 11 comes to a complete stop is better than before the rotation of the photoconductive drum 11 is started, in that it makes it easier to set up the timing. Obviously, whether the vibration generating means 51 is activated after the photoconductive drum 11 comes to a complete stop or before the rotation of the photoconductive drum 11 is started has no effects upon the effectiveness of the vibration generating means 51.

Figure 6:
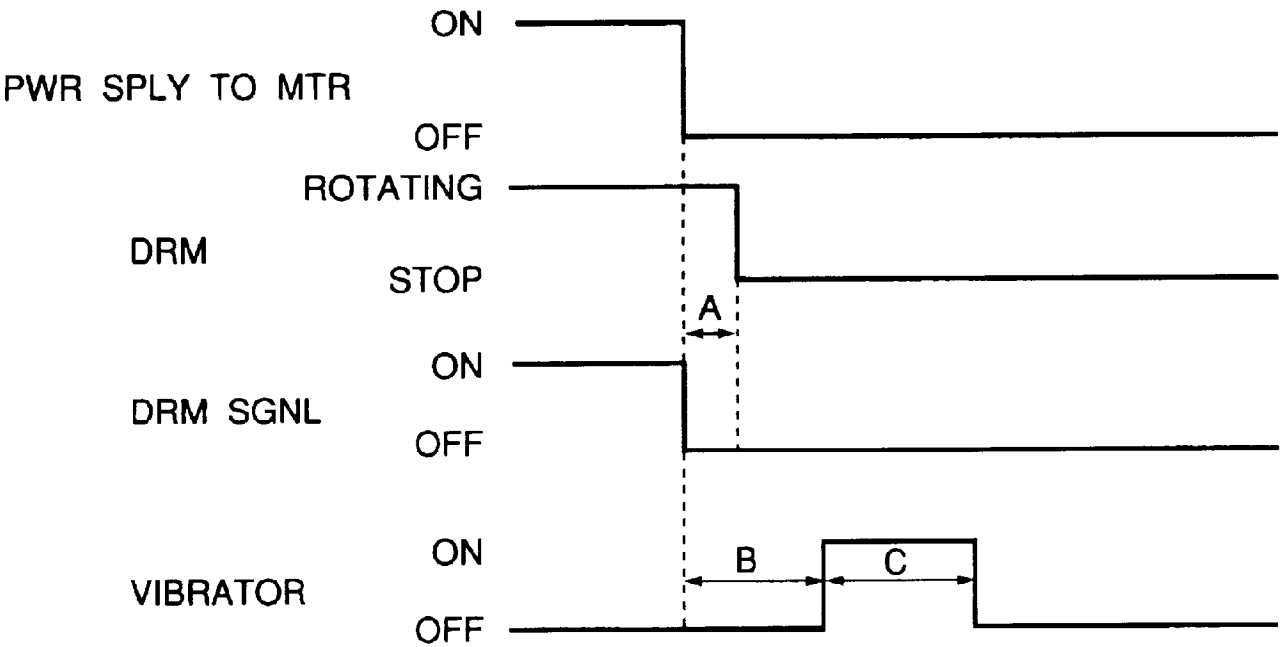
FIG. 6 is the operational sequence for the vibration generating means carried out after the interruption of the photoconductive drum rotation.

Referring to the timing chart in FIG. 6, as a drum stopping signal is issued during the rotation of the photoconductive drum 11, the power to the drum motor is stopped, eliminating thereby the mechanical power for rotating the photoconductive drum 11. However, due to inertia, the photoconductive drum 11 continues to rotate and then comes to a complete stop A seconds (predictable length of time) after the power to the drum motor is stopped. As for the value of A, it is affected by the torque necessary to rotate the photoconductive drum 11, process speed, and the like factors. Therefore, it cannot be exactly predicted; it falls in a range of 0.5–2 seconds. Obviously, the value of A may be predicted to be a value other than the values in the above given range, and such prediction of the value of A does not affect the effectiveness of the vibration generating means 51.

Thus, in consideration of the inertia-driven rotation of the photoconductive drum 11, the vibration generating means 51 is operated B seconds (predetermined length of time) after the issuing of the drum stopping signal, ensuring that the vibration generating means 51 is operated only when the photoconductive drum 11 is completely still.

The period C (seconds) in FIG. 6 is the period through which the vibration generating means 51 is continuously operated, and the value of C is optional. In this embodiment, the vibration generating means 51 is operated for approximately 0.7 second.

The value of B, in other words, the length of time after which the vibration generating means 51 is activated after the photoconductive drum 11 comes to a complete stop, may be set to the sum of the value of A and a value in the range of 0.1–1, for example. What value in the range of 0.1–1 should be selected depends on the type of a vibration generating means. Obviously, a value greater than a value in the range of 0.1–1 may be selected, and such selection does not affect the effectiveness of the vibration generating means 51.

With the increase in the cumulative operational time of the image forming apparatus, the cleaning blade 43 wears due to friction, gradually declining in its cleaning performance. Thus, the cleaning blade 43 must be replaced as necessary. With the provision of the above described structural arrangement, even when the cleaning blade 43 must be replaced, the cleaning blade 43 alone can be easily replaced by simply removing the holder 47, minimizing the component replacement cost and the number of component replacement processes, and also ensuring, by the accuracy in the processing and positioning of the contact surface 41*a* of the frame 41, that the cleaning blade 43 is accurately and safely positioned relative to the peripheral surface of the photoconductive drum 11. In order to assure that as the vibrations from the vibration generating means 51 propagate to the replacement cleaning blade, the replacement cleaning blade will behave in the same manner as the old cleaning blade it replaces, it is very important that the replacement cleaning blade can be always and easily attached to the frame 41 in the same manner as the cleaning blade it replaces.

As described above, according to this embodiment of the present invention, the cleaning blade 43 is vibrated by the vibration generating means 51, which is discrete from the cleaning blade 43, while the photoconductive drum 11 is completely still. Therefore, not only is it possible to vibrate the cleaning blade 43 vigorously enough to remove the unwanted substances, such as the toner particles agglomerating in the adjacencies of the contact portion (nip N) between the photoconductive drum 11, that is, the object to be cleaned, and the cleaning blade 43, without cost increase, but also, to prevent the substance from passing the cleaning blade while the cleaning blade 43 is vibrated.

Also according to this embodiment of the present invention, it is possible to effectively prevent the formation of an image with defects traceable to the contamination of a transfer medium resulting from improper cleaning.

Embodiment 2

Next, the second embodiment of the present invention will be described in detail with reference to an image forming apparatus equipped with the cleaning apparatus in the embodiment of the present invention. The general structures of the image forming apparatus, cleaning apparatus, and vibration generating means, are the same as those in the above described first embodiment.

In this embodiment, a sequence in which an image forming operation is interrupted to operate the vibration generating means 51 is employed.

First, the interruption of an image forming operation will be described. In this embodiment, when the number of the continuously formed copies exceeds a predetermined number, for example, 1,000, the rotation of the photoconductive drum 11 is temporarily stopped for every predetermined number of copies, for example, 1,000 in this embodiment. As the rotating photoconductive drum 11 slows to a complete stop, the manner (shape) in which the cleaning blade 43 contacts the photoconductive drum 11 slightly changes, changing thereby the shape of the nip portion between the photoconductive drum 11 and cleaning blade 43. This change in the shape of the nip portion is effective to force the toner particles agglomerating at the nip portion to fall from the nip portion. Further, in order to ensure that even the toner particles adhering to the edge 43*a* of the cleaning blade 43 are removed, the image forming operation is temporarily stopped to activate the vibration generating means 51.

Figure 7:
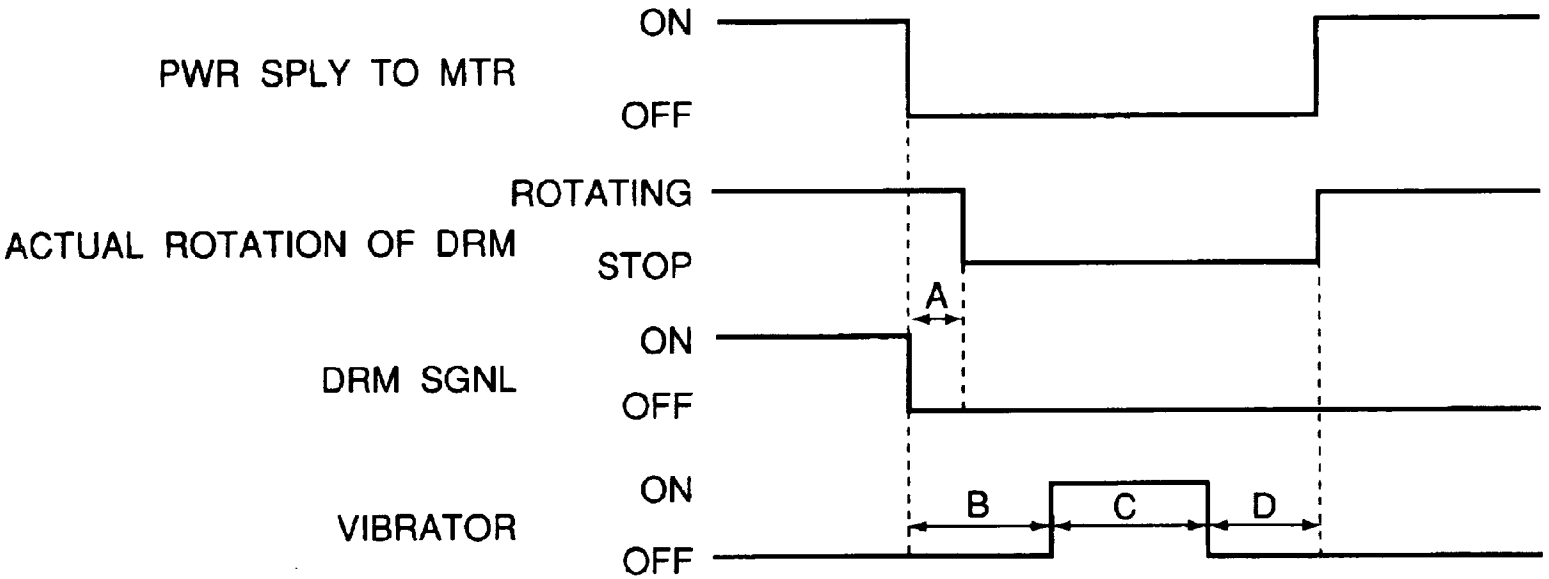
FIG. 7 is the operational sequence for the vibration generating means carried out during the intermission in an image forming operation.

Referring to the timing chart in FIG. 7, as a drum stopping signal is issued during the rotation of the photoconductive drum 11, the transmission of the power to the drum motor is stopped, eliminating thereby the mechanical power for rotating the photoconductive drum 11. However, due to inertia, the photoconductive drum 11 continues to rotate A seconds (predictable length of time) before it comes to a complete stop after the power to the drum motor is stopped. As for the value of A, it is affected by the torque necessary to rotate the photoconductive drum 11, process speed, and the like factors. Therefore, it cannot be exactly predicted; it falls in a range of 0.5–2. Obviously, the value of A may be predicted to be a value other than the values in the above given range, and such prediction of the value of A does not affect the effectiveness of the vibration generating means 51.

Thus, in consideration of the inertia-driven rotation of the photoconductive drum 11, the vibration generating means 51 is activated B seconds (predetermined length of time) after the issuing of the drum stopping signal, ensuring that the vibration generating means 51 is operated only when the photoconductive drum 11 is completely still.

The period C (seconds) in FIG. 7 is the duration of the operation of the vibration generating means 51, and the value of C is optional. In this embodiment, the vibration generating means 51 is operated for approximately 0.7 second.

The value of the B, in other words, the length of time after which the vibration generating means 51 is activated after the photoconductive drum 11 comes to a complete stop, may be set to the sum of the value of A and a value in a range of 0.1–1, for example. What value in the range of 0.1–1 should be selected depends on the type of a vibration generating means. Obviously, a value greater than a value in the range of 0.1–1 may be selected, and such selection does not affect the effectiveness of the vibration generating means 51.

The rotation of the photoconductive drum 11 is restarted D seconds from the end of the operation of the vibration generating means 51 in order to continue the interrupted image forming operation. Regarding the value of D, immediately after the end of the operation of the vibration generating means 51, it is possible that the vibrations from the vibration generating means 51 will not have completely subsided, and therefore, it is desired that the drum rotation signal is not started for a predetermined length of time from the end of the operation of the vibration generating means 51.

Thus, the value of D, or the predetermined value, has only to be in the range of 0.1–1. What value in the range of 0.1–1 should be selected depends on the type of a vibration generating means. Obviously, a value greater than a value in the range of 0.1–1 may be selected, and such selection does not affect the effectiveness of the vibration generating means 51.

Embodiment 3

Next, the third embodiment of the present invention will be described in detail with reference to an image forming apparatus equipped with the cleaning apparatus in this embodiment. The general structures of the image forming apparatus, cleaning apparatus, and vibration generating means, are the same as those in the above described first embodiment.

In this embodiment, a sequence, in which the vibration generating means 51 is operated during the intermission of an image forming operation provided for cleaning the wire of a corona type charging device (primary charging device 12), is shown.

First, the operation for cleaning the wire of a corona type charging device, for which an image forming operation is temporarily stopped, will be described. When continuously forming a predetermined number copies, for example, 2,000 copies or more, the wire of a corona type charging device must be cleaned for every predetermined number of copies, for example, 2,000. If the wire of a corona type charging device is not cleaned every time a predetermined number of copies are completed, the contamination of the wire causes corona to unevenly discharge, resulting in the problem; for example, the photoconductive drum 11 is nonuniformly charged in terms of potential level, and/or a toner image is nonuniformly transferred. Thus, it is a common practice that when continuously forming a predetermined number of images, the image forming operation is temporarily suspended to clean the wire of a corona type charging device. In this embodiment, therefore, the period during which the image forming operation is suspended to clean the wire of the corona type charging device is utilized for operating the vibration generating means 51 to removing the residual toner particles having agglomerated at the edge 43*a* of the cleaning blade 43.

Figure 10:
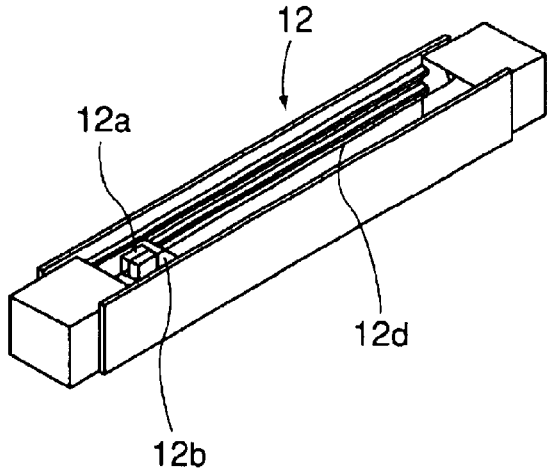
FIG. 10 is a perspective view of a cleaning means for cleaning the wire of a corona type charging device.
Figure 11:
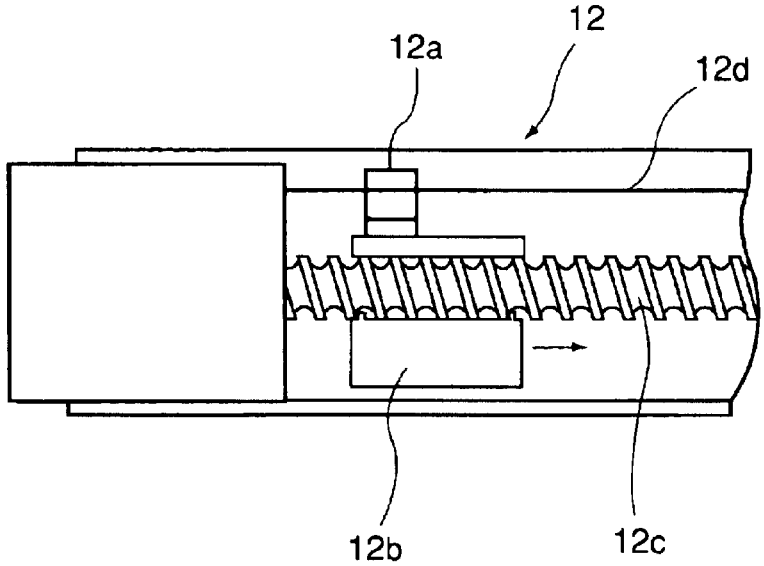
FIG. 11 is an enlarged schematic view of the driving portion of the cleaning means for cleaning the wire of a corona type charging device.

As for a means for cleaning the wire of the primary charging device 12, a structure such as those shown in FIGS. 10 and 11 is employed. More specifically, a wire 12*d* is cleaned as a cleaning member 12*a*, which is embracing the wire 12*d*, is moved in the direction indicated by an arrow mark in FIG. 11. A structural arrangement is provided so that a cleaning member mount 12*b* to which the cleaning means 12*a* is attached is moved by the screw 12*c* rotated by an unshown driving means. The configuration of the cleaning means does not need to be limited to the one in this embodiment. Not only can this type of cleaning means be used for the charging means, but also for the transferring means and separating means.

Figure 8:
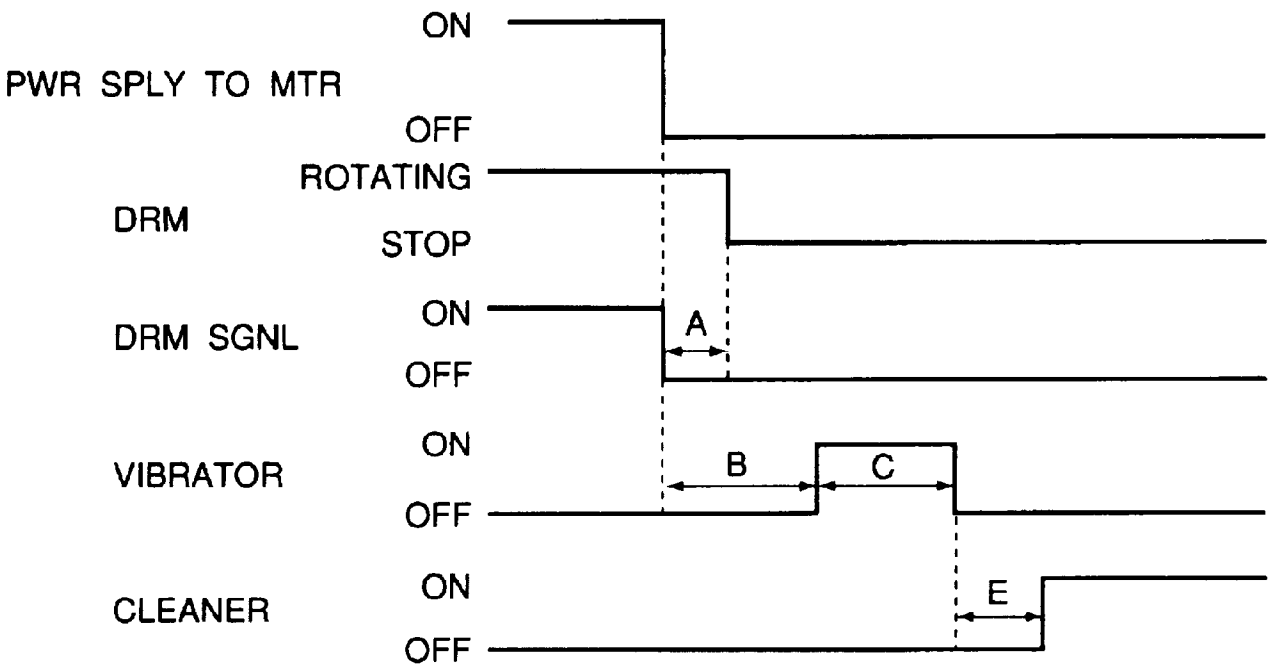
FIG. 8 is the operational sequence for the vibration generating means carried out during the intermission in an image forming operation provided for cleaning the wire of a corona type charging device.

Referring to the timing chart in FIG. 8, as a drum stopping signal is issued during the rotation of the photoconductive drum 11, the transmission of the power to the drum motor is stopped, eliminating thereby the mechanical power for rotating the photoconductive drum 11. However, due to inertia, the photoconductive drum 11 continues to rotate for A seconds (predictable length of time) before it comes to a complete stop after the power to the drum motor is stopped. As for the value of A, it is affected by the torque necessary to rotate the photoconductive drum 11, process speed, and the like factors. Therefore, it cannot be exactly predicted; it falls in a range of 0.5–2. Obviously, the value of A may be predicted to be a value other than the values in the above given range, and such prediction of the value of A does not affect the effectiveness of the vibration generating means 51.

Thus, in consideration of the inertia-driven rotation of the photoconductive drum 11, the vibration generating means 51 is activated B seconds (predetermined length of time) from the inputting of the drum stopping signal, ensuring that the vibration generating means 51 is operated only when the photoconductive drum 11 is absolutely standing still.

The period C (seconds) in FIG. 8 is the period in which the vibration generating means 51 is continuously operated, and the value of C is optional. In this embodiment, the vibration generating means 51 is operated for approximately 0.7 second.

The value of the B, in other words, the length of time after which the vibration generating means 51 is activated after the photoconductive drum 11 comes to a complete stop, may be set to the sum of the value of A and a value in a range of 0.1–1, for example. What value in the range of 0.1–1 should be selected depends on the type of a vibration generating means. Obviously, a value greater than a value in the range of 0.1–1 second may be selected; and such selection does not affect the effectiveness of the vibration generating means 51.

The operation for cleaning the wire of the corona type charging device is started E seconds from the completion of the operation of the vibration generating means 51. As for the value of E, there will be no problem even if the wire cleaning means is activated at the same time as the operation of the vibration generating means 51 ends. For example, it may be in the range of 0–1. What value in the range of 0–1 should be selected depends on the type of a vibration generating means. Obviously, a value greater than a value in the range of 0–1 second may be selected, and such selection does not affect the effectiveness of the vibration generating means 51.

In this embodiment, a sequence, in which after the photoconductive drum 11 comes to a complete stop, first, the vibration generating means 51 is operated, and thereafter, the wire cleaning operation is carried out, was employed. However, another sequence, in which after the photoconductive drum 11 comes to a complete stop, the wire cleaning operation is first carried out, and thereafter the vibration generating means 51 is operated, may be employed.

Embodiment 4

The inventors of the present invention carried out various additional experiments, discovering the following: For the purpose of removing the toner particles agglomerating at the edge of the cleaning blade 43, increasing the operational count was more effective than increasing the length of time the motor 52 was operated per residual toner removing operation. This is for the following reason. That is, the initial impact to which the cleaning blade 43 is subjected the moment the vibrations from the motor 52 initially hit the cleaning blade 43 is more effective to remove the agglomeration of the toner particles than the continual impacts to which the cleaning blade 43 is subjected as the vibrations continually arrive from the motor 52.

Figure 24:
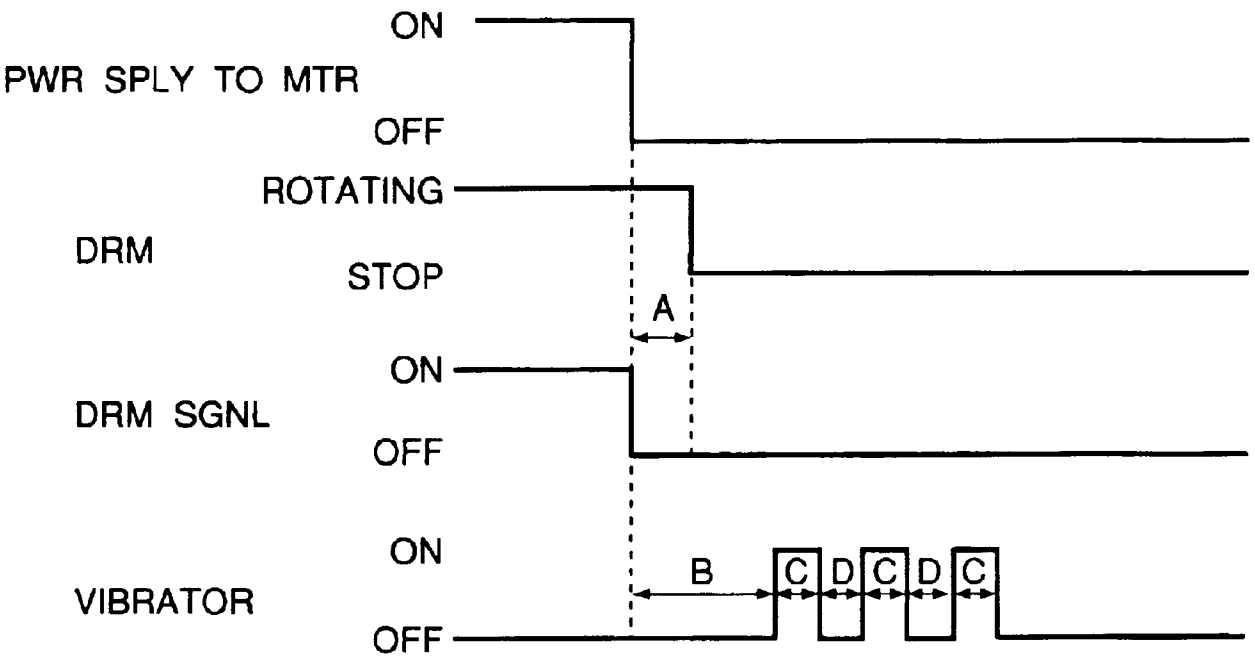
FIG. 24 is a timing chart for the vibration generating means operation, in which the vibration generating means is activated twice or more.

Referring to FIG. 24, in this embodiment, therefore, the length C (power-on-time) of time the motor 52 is driven by transmitting power thereto is set to the sum of the time it takes for the motor 52 to reach its normal operational speed (normal state) and some margin. On the other hand, the length D (power-off-time) of time the motor 52 is kept standing still by interrupting the transmission of power thereto is set to the sum of the time it takes for the cleaning blade 43 to become absolutely still, and some margin. In other words, control is executed so that a vibration sequence, in which the motor 52 is driven for a predetermined length of time and then, is not driven for a predetermined length of time, is repeated a predetermined number of times. When the vibrations from the motor 52 are transmitted to the cleaning blade 43 through the frame 21 while controlling the motor 52 in the above described manner (FIG. 3(*c*)), the agglomeration of toner particles formed at the edge portion of the cleaning blade 43 can be more effectively removed (FIG. 3(*b*)).

In this embodiment, the above described vibration sequence is repeated three times. However, the number of times the vibration sequence is repeated does not need to be limited to three times.

In the preceding embodiments described above, the fan shaped plummet 53 (weight) was attached to the output shaft of the motor 52. This structural arrangement, however, was made to efficiently generate vibrations by the rotations of the motor 52, and is not mandatory. In other words, as long as the vibrations occur as the motor 52 rotates, the plummet 53 does not need to be fan-shaped.

Embodiment 5

Next, the amount of the vibrations generated by a vibration generating means in accordance with the present invention will be described.

For the sole purpose of removing the toner particle agglomeration formed at the edge portion of the cleaning blade 43 by controlling the transmission of power to the vibration motor 52, all that is necessary is to make the aforementioned frame 41 to vibrate just enough to remove the agglomeration, because excessively vibrating the frame 41 leads to excessive vibration of the cleaning blade 43, which may result in the scattering of the agglomerated toner particles (waste toner particles).

Thus, in this embodiment, in order to efficiently break down the agglomeration of toner particles, a structural arrangement is made so that the magnitude of the vibrations of the frame 41 or cleaning blade 43 is greater while the vibration motor is on than while an image is actually formed.

Generally, the amount of vibrations is quantified in terms of acceleration, displacement, or the like. The studies made by the applicants of the present invention revealed that when the vibratory acceleration of the frame 41 or cleaning blade 43 while the vibration motor was on was approximately ten times the vibratory acceleration of the frame 41 or cleaning blade 43 while an image is actually formed, the toner particle agglomeration could be satisfactorily removed. While an image is actually formed, the vibratory acceleration of the edge of the cleaning blade 43 was approximately $(1.0\pm0.5)/sec^2$. The vibrations of the frame 41 or cleaning blade 43 are primarily traceable to the friction between the cleaning blade 43 and photoconductive drum 11. While the vibratory acceleration of the frame 41 or cleaning blade 43 remains within the above range, the toner particle agglomeration continues to grow at the blade edge. It has been confirmed that a residual toner agglomeration which is no less than 1 mm in height and no less than 2 mm in width results in an image defect In order to remove such a residual toner agglomeration, the cleaning blade 43 had to be vibrated by the vibration generating means (motor unit 51) in such a fashion that the vibratory acceleration of the cleaning edge of the cleaning blade 43 reached 10 $m/sec^2$ or more. It was also confirmed that when the vibratory acceleration exceeded 1000 $m/sec^2$, the scattering of the toner worsened. Thus, the proper range for the vibratory acceleration is the range of 10–1000 $m/sec^2$.

As described above, in this embodiment, a plurality of motor units 52, for example, two in this embodiment, are attached to the frame 41 to which the cleaning blade 43, which is placed in contact with the photoconductive drum 11, is attached, so that the cleaning edge of the cleaning blade 43 is vibrated by the vibrations generated by these motor units 51, just enough to remove the residual toner particles agglomerating at the cleaning edge portion of the cleaning blade 43. Therefore, it is possible to provide an image forming apparatus capable of forming high quality images, that is, images free of the defects traceable to the residual toner particles.

Further, the minimum amount of vibrations was defined, making it possible to provide an image forming apparatus which is low in operational noise and power consumption and is long in service life.

In this embodiment, the amount of vibrations was defined in terms of acceleration. However, such definition is not mandatory. For example, it may be defined in terms of displacement. It was confirmed through the studies conducted by the applicants of the present invention that while an image forming operation was carried out, the displacement of the surrounding area of the cleaning blade was approximately several microns, and that when the vibratory displacement of the surrounding area of the cleaning blade caused by the aforementioned vibration generating means was approximately ten times the vibratory displacement of the surrounding area of the cleaning blade which occurred while an image was actually formed, the residual toner agglomeration could be satisfactorily removed. Thus, the vibration generating means has only to be set up so that the amount of the displacement of the surrounding area of the cleaning blade becomes ten times or more the amount of the displacement of the surrounding area of the cleaning blade which occurs while an image is actually formed.

Embodiment 6

In this embodiment, the operation of the vibration generating means is controlled based on the ambient temperature and humidity.

Temperature Detecting Means

Figure 12:
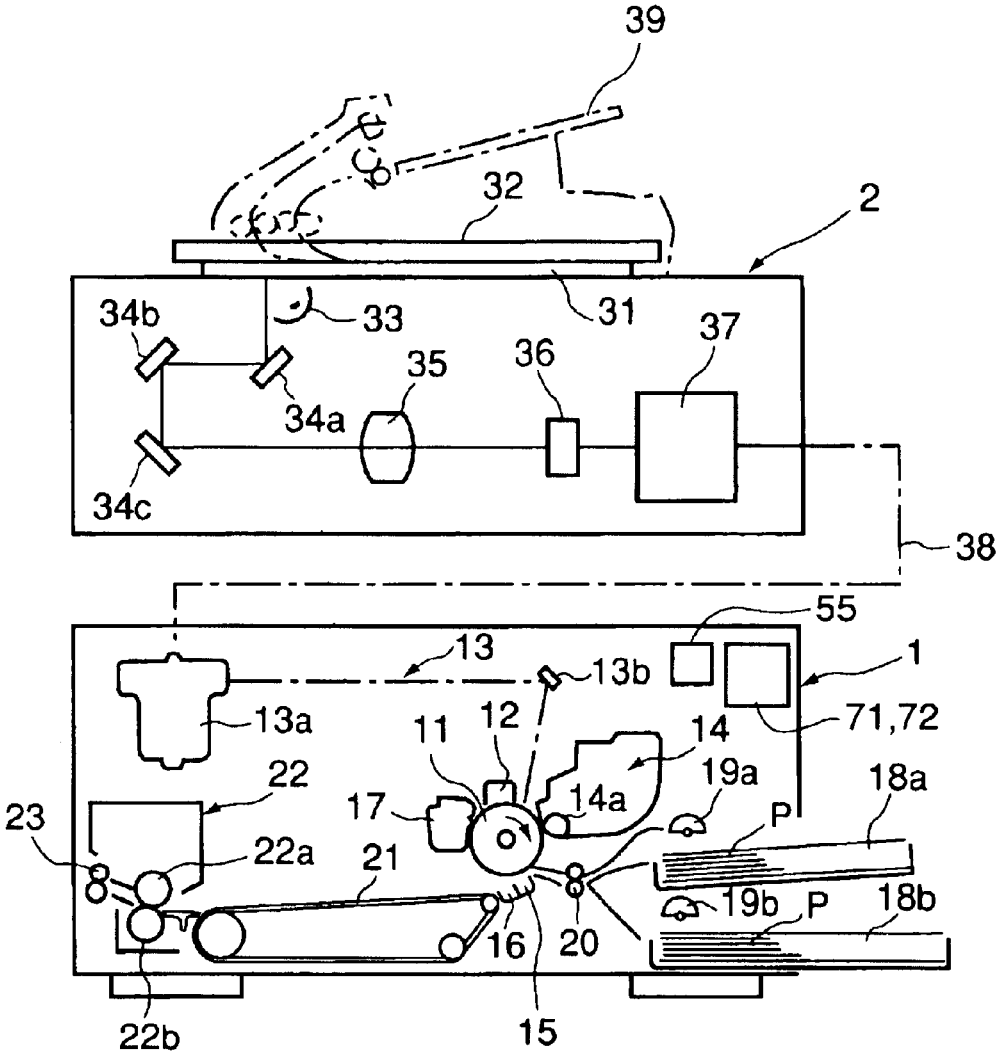
FIG. 12 is a vertical sectional view of another image forming apparatus, for showing an image forming apparatus structure other than the above described one.

FIG. 12 shows a temperature detecting means 71. The temperature detecting means 71 in this embodiment primarily detects ambient temperature. Therefore, the location to which the temperature detecting means 71 is attached does not need to be close to the cleaning blade 43; there will be no problem even if the temperature detecting means 71 is placed away from the cleaning blade 43 as shown in the drawing. However, the temperature detecting means 71 should not be placed in the adjacencies of the fixing device 22, since such placement subjects the temperature detecting means 71 to the heat from the fixing device 22.

The information detected by the temperature detecting means 71 is sent to the control circuit 55 as a controlling means, shown in FIG. 4 and mentioned in the description of the first embodiment. The control circuit 55 controls the vibration generating means 51 based on this information detected by the temperature detecting means 71.

Relationship between Temperature and Agglomeration

Figure 9:
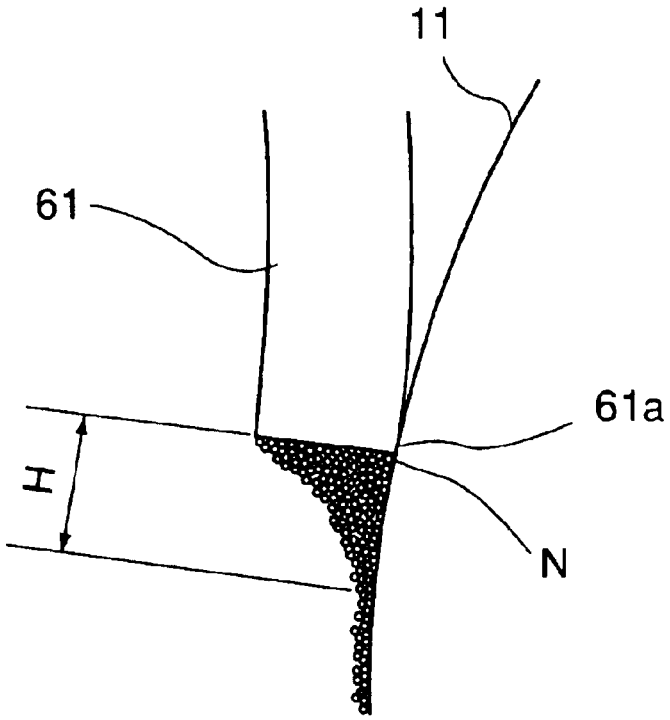
FIG. 9 is an enlarged schematic view for showing the manner in which the toner particles agglomerate in the adjacencies of the edge of a cleaning blade.
Figure 13:
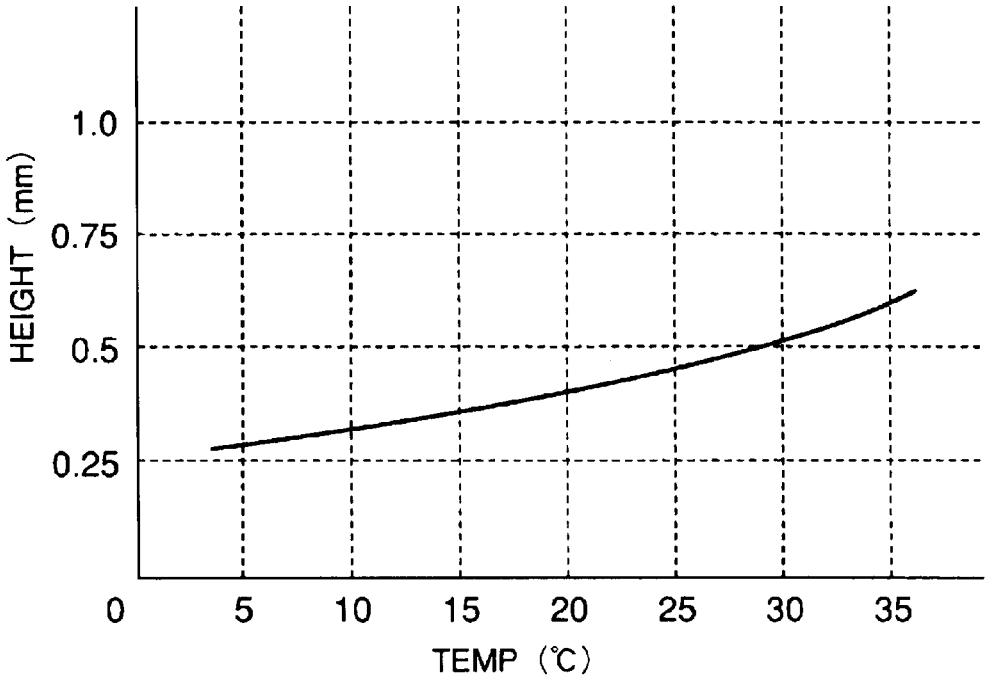
FIG. 13 is a graph showing the relationship between the temperature and height of the toner agglomeration.

FIG. 13 shows the relationship between the temperature and toner particle agglomeration. Referring to FIG. 9, the height of the agglomeration means the distance H between the edge of the cleaning blade and the end of the toner particle agglomeration on the side opposite to the cleaning blade. It is evident from FIG. 13 that as the temperature rises, the height of the agglomeration increases. The relationship shown in FIG. 13 represents the results of an experiment in which the vibration generating means was not used.

As for the details of the experiment, an image forming apparatus with a process speed of 480 mm/sec was employed, and 50,000 copies were made from an original, the image ratio of which was 4%. Then, the height of the toner particle agglomeration at the edge of the cleaning blade was measured. It is evident from the results of this experiment that there is a tendency that the higher the ambient temperature, the higher the agglomeration.

It became evident from the above described experiment involving the formation of 50,000 copies that as the agglomeration grows taller than 0.5 mm, the waster toner particles passed through the nip N between the edge 61*a* of the cleaning blade 61 and the peripheral surface of the photoconductive drum 11.

Thus, in this embodiment, based on the results of this experiment, when the temperature detected by the temperature detecting means 71 was no less than 28° C., the ambient temperature was considered to be in the high range.

Timing

Next, the operational timing for the vibration generating means 51 will be described.

In this embodiment, when the temperature detected by the temperature detecting means 71 is higher than a predetermined temperature (28° C. in this embodiment), the vibration generating means 51 is operated according to the following sequences.

However, the sequences described below are examples of the operational sequences for the vibration generating means 51. It is not necessary that when the detected temperature is no less than 28° C., all the sequences are to be carried out; in other words, only one of the following sequences may be carried out, or a plurality of them may be carried out.

As the examples of the operational timing for the vibration generating means, it is possible to list (1) when an image forming apparatus is activated for the first time for the day (sequence shown in FIG. 6), (2) when an image forming operation is interrupted to operate the vibration generating means (sequence shown in FIG. 7), and (3) when an image forming operation is interrupted to clean the wire of a corona-type charging means (sequence shown in FIG. 8). The sequence carried out with the above timings are the same as the sequence in the first embodiment, except that in this embodiment, the sequence is initiated only when the temperature detected by the temperature detecting means is no less than a predetermined level.

As described above, according to this embodiment of the present invention, the vibration generating means 51 is activated only when the ambient temperature makes it necessary for the vibration generating means to be operated. Therefore, the vibration generating means 51 lasts longer while maintaining a proper level of image quality.

Embodiment 7

Next, an image forming apparatus equipped with the cleaning apparatus in the seventh embodiment of the present invention will be described in detail. The general structures of the image forming apparatus, cleaning apparatus, and vibration generating means, are the same as those in the above described first embodiment.

Humidity Detecting Means

FIG. 12 shows the humidity detecting means 72. The humidity detecting means 72 in this embodiment primarily detects the ambient humidity. Therefore, the location to which the humidity detecting means 72 is attached does not need to be close to the cleaning blade: there will be no problem even if the humidity detecting means 72 is placed away from the cleaning blade as shown in the drawing. However, the humidity detecting means 72 should not be placed in the adjacencies of the fixing device 22, since such placement subjects the humidity detecting means 72 to the heat and moisture from the fixing device 22.

The information detected by the humidity detecting means 72 is sent to the control circuit 55 as a controlling means, shown in FIG. 4 and mentioned in the description of the first embodiment. The control circuit 55 controls the vibration generating means 51 based on this information detected by the humidity detecting means 72

Relationship between Humidity and Agglomeration

Figure 14:
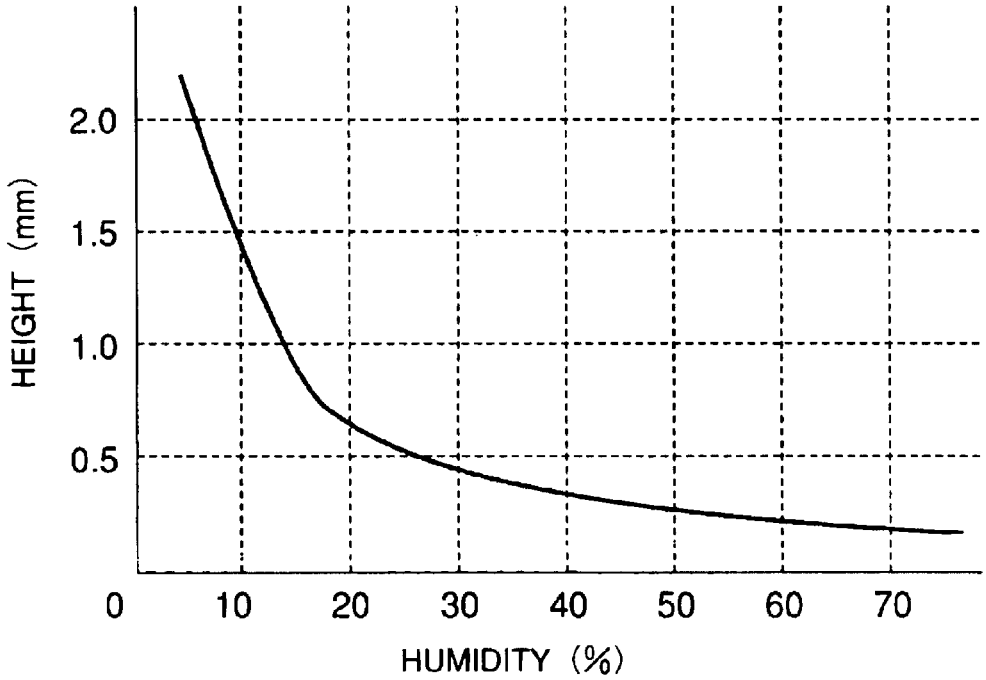
FIG. 14 is a graph showing the relationship between the temperature and height of the toner agglomeration.

FIG. 14 shows the relationship between the humidity and toner particle agglomeration. Referring to FIG. 9, the height of the agglomeration means the distance H between the edge of the cleaning blade and the end of the toner particle agglomeration on the side opposite to the cleaning blade. It is evident from FIG. 14 that the lower the humidity, the higher the agglomeration. The relationship shown in FIG. 14 represents the results of an experiment in which the vibration generating means was not used.

As for the details of the experiment, an image forming apparatus with a process speed of 480 mm/sec was employed, and 50,000 copies were made from an original, the image ratio of which was 4% Then, the height of the toner particle agglomeration at the edge of the cleaning blade was measured. It is evident from the results of this experiment that there is a tendency that the lower the ambient humidity, the higher the agglomeration.

It became evident from the above described experiment involving the formation of 50,000 copies that as the agglomeration grows taller than 0.5 mm, the waster toner particles passed through the nip N between the edge 61*a* of the cleaning blade 61 and the peripheral surface of the photoconductive drum 11.

Thus, in this embodiment, based on the results of this experiment, when the humidity detected by the humidity detecting means 72 was no more than 30%, the ambient humidity was considered to be in the low range.

Timing

Next, the operational timing of the vibration generating means 51 will be described. The operational timing and sequence for the vibration generating means 51 are the same as those in the sixth embodiment.

In this embodiment, when the humidity detected by the humidity detecting means 72 was no more than a predetermined level (30% in this embodiment), the vibration generating means 51 was activated according to one or plurality of the combinations of the operational timing and sequence in the sixth embodiment.

However, the combinations of the operational timing and sequence in the sixth embodiment are merely the examples of the combinations of the operational timing and sequence for the vibration generating means 51. Thus, it is not necessary that when the detected humidity is no more than 30%, all the combinations of the timing and operational sequence are to be carried out; in other words, only one of the combinations may be carried out, or a plurality of them may be carried out.

As described above, according to this embodiment of the present invention, the vibration generating means is activated only when the ambient humidity makes it necessary for the vibration generating means to be operated. Therefore, the vibration generating means lasts longer while maintaining a proper level of image quality.

Embodiment 8

Next, an image forming apparatus equipped with the cleaning apparatus in the eighth embodiment of the present invention will be described in detail. The general structures of the image forming apparatus, cleaning apparatus, and vibration generating means, are the same as those in the above described first embodiment.

Figure 15:
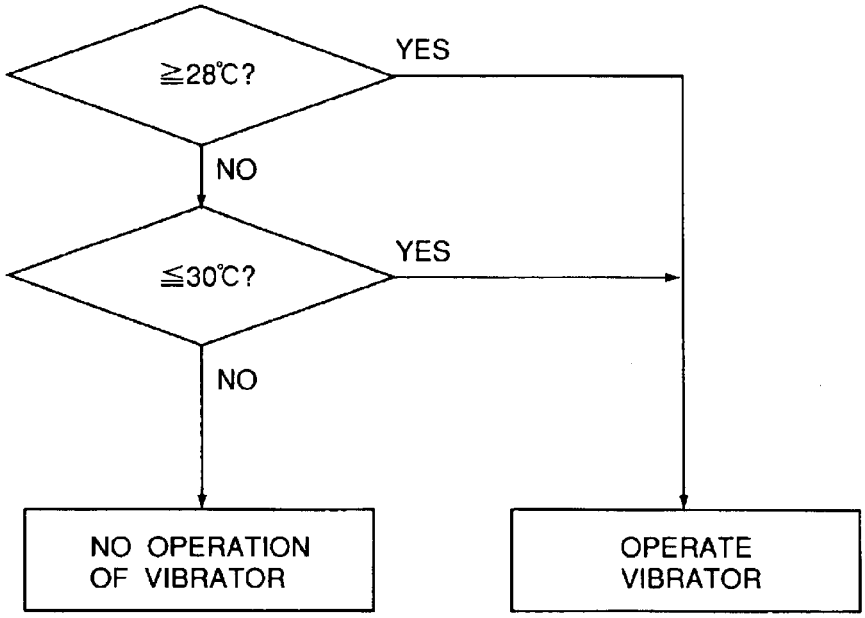
FIG. 15 is a flowchart for determining, based on the temperature and humidity, whether or not the vibration generating means is to be activated.

In this embodiment, whether the vibration generating means 51 is to be activated or not is determined based on both the temperature and humidity detected by the temperature detecting means 71 and humidity detecting means 72, respectively. FIG. 15 shows an example of a flowchart for such a vibration generating means operation.

The information detected by the temperature detecting means 71 and humidity detecting means 72 is sent to the control circuit 55 as a controlling means shown in FIG. 4, which will be described later. The control circuit 55 controls the vibration generating means 51 based on this information.

In this embodiment, first, whether or not the temperature detected by the temperature detecting means 71 is no less than a predetermined temperature of 28° C. is determined. If it is no less than 28° C., the vibration generating means 51 is to be operated, whereas if it is no more than 28° C., the vibration generating means 51 is not to be operated unless the following condition regarding the ambient humidity is met. Next, when the temperature detected by the temperature detecting means 71 is no more than 28° C., whether or not the humidity detected by the humidity detecting means 72 is no more than a predetermined humidity of 30% is determined. If it is no more than 30%, the vibration generating means 51 is to be operated, whereas if it is no less than 30%, the vibration generating means 51 is not to be operated.

As for when the ambient temperature and humidity should be detected by the temperature detecting means 71 and humidity detecting means 71, respectively, the ambient temperature and humidity may be detected every predetermined length of time, or each time a predetermined number of copies are completed, in addition to when an image forming apparatus is turned on. When the ambient temperature and humidity are detected does not affect the effectiveness of the vibration generating means.

Timing

The operational timing and sequence of the vibration generating means 51 in this embodiment are the same as those in the sixth embodiment.

In this embodiment, when it is determined through the operation carried out following the flowchart in FIG. 15 that the vibration generating means 51 is to be operated, the vibration generating means 51 is operated based on a single or plurality of the combinations of the operational timing and sequence.

However, the combinations of the operational timing and sequence in the sixth embodiment are merely examples of the combinations of the operational timing and sequence for the vibration generating means 51. It is not necessary to carry out all the combinations of the timing and operational sequence; in other words, only one of the combinations may be carried out, or a plurality of them may be carried out.

As described above, according to this embodiment of the present invention, the vibration generating means is activated only when the ambient conditions make it necessary for the vibration generating means to be operated. Therefore, the vibration generating means lasts longer while maintaining a proper level of image quality.

Embodiment 9

Next, an image forming apparatus equipped with the cleaning apparatus in the ninth embodiment of the present invention will be described in detail. The general structures of the image forming apparatus, cleaning apparatus, and vibration generating means, are the same as those in the above described first embodiment.

Figure 16:
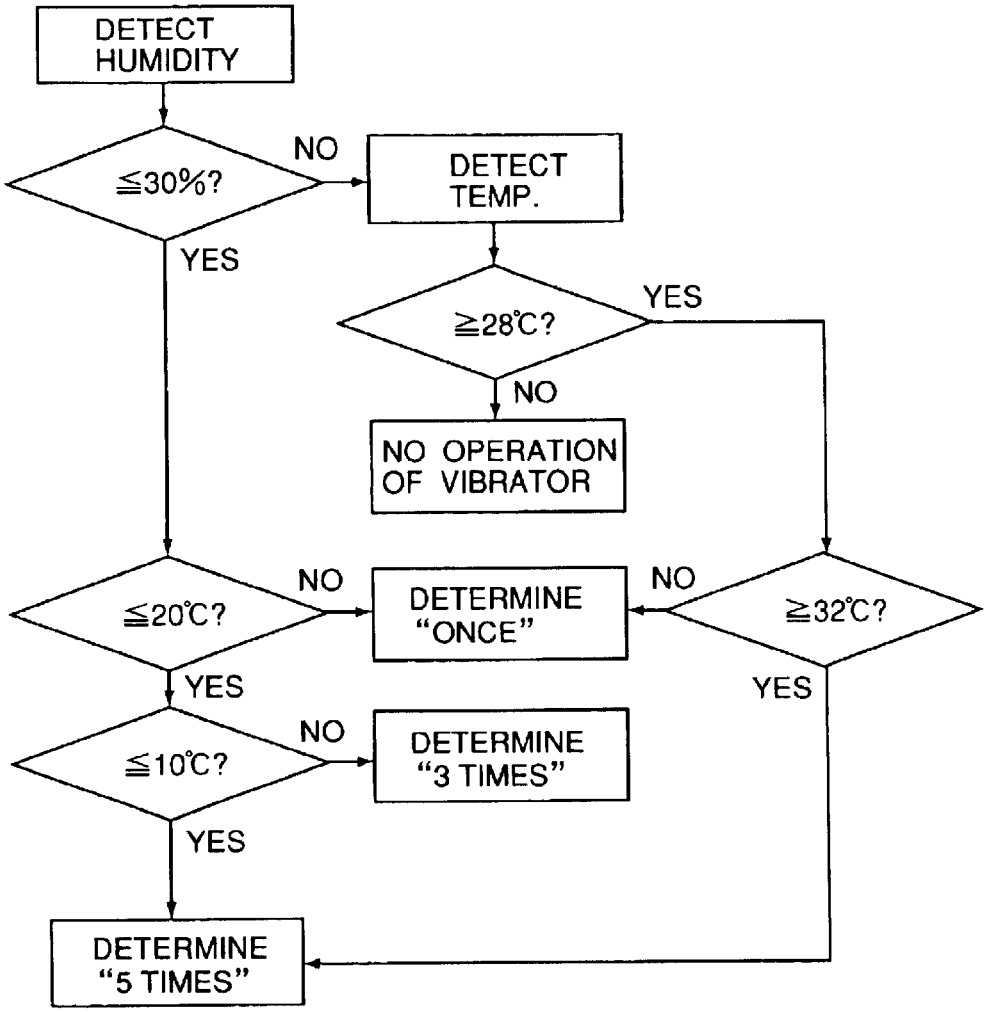
FIG. 16 is a flowchart for determining, based on the temperature and humidity, how many times the vibration generating means is to be activated.

In this embodiment, how many times the vibration generating means 51 is to be activated is determined based on both the temperature and humidity detected by the temperature detecting means 71 and humidity detecting means 72, respectively. FIG. 16 shows an example of a flowchart for such a vibration generating means operation.

The information detected by the temperature detecting means 71 and humidity detecting means 72 are sent to the control circuit 55 as a controlling means shown in FIG. 4, which will be described later. The control circuit 55 controls the vibration generating means 51 based on this information.

In this embodiment, first, whether or not the humidity detected by the humidity detecting means 72 is no more than a predetermined humidity of 30% is determined. If it is no more than 30%, whether or not it is no more than 20% is determined. Then, if it is no more than 20%, whether or not it is no more than 10% is determined. If it is no more than 10%, the vibration generating means 51 is to be operated five times. If it is in the range of 10%–20%, the vibration generating means 51 is to be operated three times. If it is in the range of 20%–30%, the vibration generating means 51 is operated once. On the other hand, when the humidity is no less than 30%, how many times the vibration generating means 51 is to be operated is determined based on the temperature detected by the temperature detecting means 71. Similarly to the case of the humidity, if the temperature detected by the temperature detecting means 71 is in the range of 28° C.–32° C., the vibration generating means 51 is to be operated once, and if it is no less than 32° C., the vibration generating means 51 is to be operated five times. If it is no more than 28° C., the vibration generating means 51 is not to be operated.

As for when the ambient temperature and humidity should be detected by the temperature detecting means 71 and humidity detecting means 71, respectively, the ambient temperature and humidity may be detected every predetermined length of time, or each time a predetermined number of copies are completed, in addition to when an image forming apparatus is turned on. When the ambient temperature and humidity are detected does not affect the effectiveness of the vibration generating means.

Timing

The operational timing and sequence for the vibration generating means 51 in this embodiment are the same as those in the first embodiment.

In this embodiment, when it is determined through the operation carried out following the flowchart in FIG. 16 that the vibration generating means 51 is to be operated, the vibration generating means 51 is operated according to the operational timing and sequence in the first embodiment.

However, the sequence shown in the first embodiment is only one example of an operational sequence for the vibration generating means 51 Thus, it is unnecessary for all of the combinations of the above described timing and sequence to be carried out by the vibration generating means 51. In other words, only one combination of the timing and sequence may be carried out by the vibration generating means 51, or a plurality of the combinations of the timing and sequence may be carried out, which is obvious Further, it is unnecessary to always stick to the operational count determined based on the ambient conditions. For example, the operational schedule for the vibration generating means 51 may be such that only when the image forming apparatus is started for the first time for the day, the selected combination of the operational timing and sequence is carried out the number of times determined based on the ambient conditions, and otherwise, it is carried out only once if the ambient conditions require.

As described above, according to this embodiment of the present invention, the operational schedule for the vibration generating means is optimized at a higher level, making it possible for the vibration generating means to last longer while maintaining a satisfactory level of image quality.

Embodiment 10

In this embodiment, the operation of the vibration generating means is controlled according to the fixing means temperature.

Sequence (1) Fixing Apparatus

Figure 17:
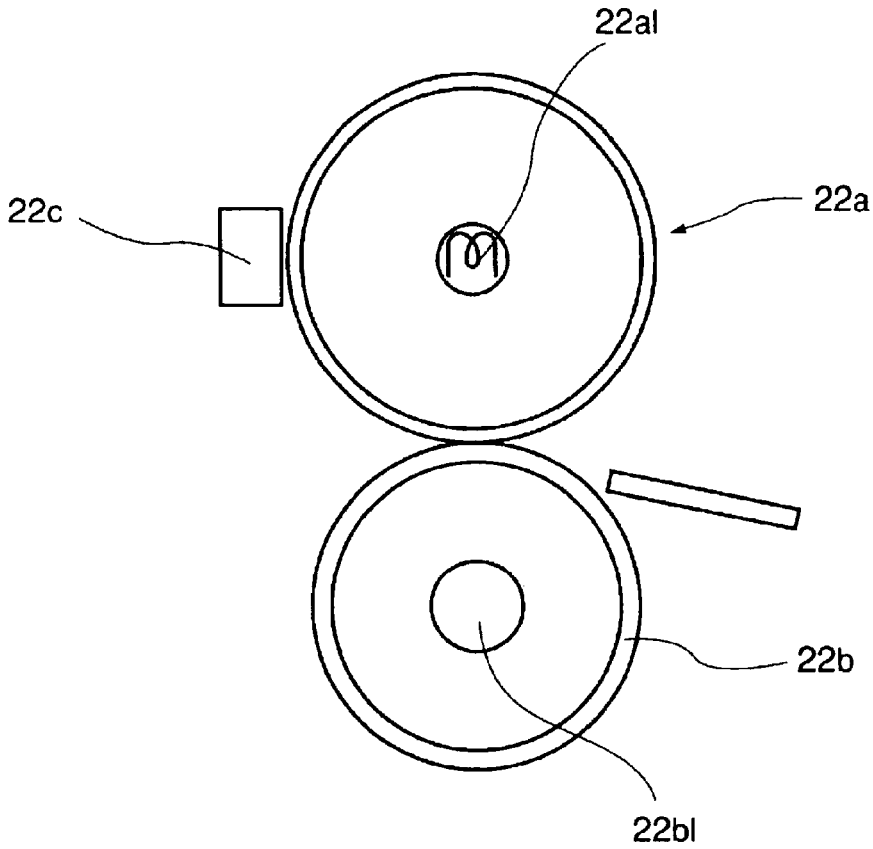
FIG. 17 is a schematic sectional view of the fixing means, for showing the general structure thereof.

First, a fixing apparatus will be described. Referring to FIG. 17, a referential code 22*a* stands for a fixing roller; 22*a*1, a heating means; 22*b*, a pressing roller; 22*b*1, a metallic core; and a referential code 22*c* stands for a temperature detecting means for detecting the surface temperature of the fixing roller 22*a*. Although this embodiment is described with reference to a fixing apparatus structured as shown in FIG. 17, the application of the present invention does not need to be limited to the fixing apparatus in this embodiment. For example, the present invention is also compatible with a fixing apparatus having a temperature detecting means different from the one in this embodiment, for example, a fixing apparatus in which its fixing roller and pressure roller have a heating means, a fixing apparatus employing a film, a fixing apparatus of an electromagnetic induction type, or the like.

Further, the temperature detected by the temperature detecting means does not need to be limited to the surface temperature of the fixing roller. For example, it may be the surface temperature of the pressing roller. Further, in the case of a film type fixing apparatus, it may be the surface temperature of the adjacencies of the heater, the surface temperature of the film, or the like.

(2) Method for Determining Whether or not Vibration Generating Means is to be Activated Here, a method for determining whether or not the vibration generating means 51 should be activated will be described. In this embodiment, first, the surface temperature of the fixing roller 22*a* is detected by the temperature detecting means 22*c*. When the detected temperature is no higher than a predetermined temperature t1, the fixing roller 22*a* is heated by the heating means 22*a*1 until the detected temperature reaches the normal temperature at which image formation is possible. Regarding the heating of the fixing roller 22*a*, it is common practice that, at the beginning, the fixing roller 22*a* is heated while being kept stationary, whereas after the surface temperature of the fixing roller 22*a* reaches a predetermined one t2, the multiple pre-rotations are started; in this embodiment, the surface temperature of the fixing roller 22*a* set for image formation, and predetermined temperatures t1 and t2, were 190° C., 180° C., and 170° C., respectively.

Incidentally, even if the temperatures selected as the referential temperatures for the vibration generating means activation are different from those chosen in this embodiment, the method for determining whether or not the vibration generating means 51 should be activated will remain the same.

(3) Operational Timing for Vibration Generating Means (3-1) After Pre-Rotation

Next, the sequence followed by the vibration generating means 51 when the vibration generating means 51 is activated after the multiple pro-rotations will be described.

As the temperature of the fixing device 22 detected by the temperature detecting means 22*c* reaches a predetermined level, the rotation of at least the fixing roller 22*a* and pressing roller 22*b* is started. It is assumed that as the rotation of the fixing roller 22*a* and pressing roller 22*b* is started, at least the rotation (which hereinafter will be referred to as "multiple pre-rotations") of the photoconductive drum 11 is started. In this case, it is not mandatory that the multiple pre-rotations of the photoconductive drum 11 are started at the same time as the rotation of the fixing roller 22*a* and the like is started. In this embodiment, the predetermined temperature was set to 170° C.

Figure 18:
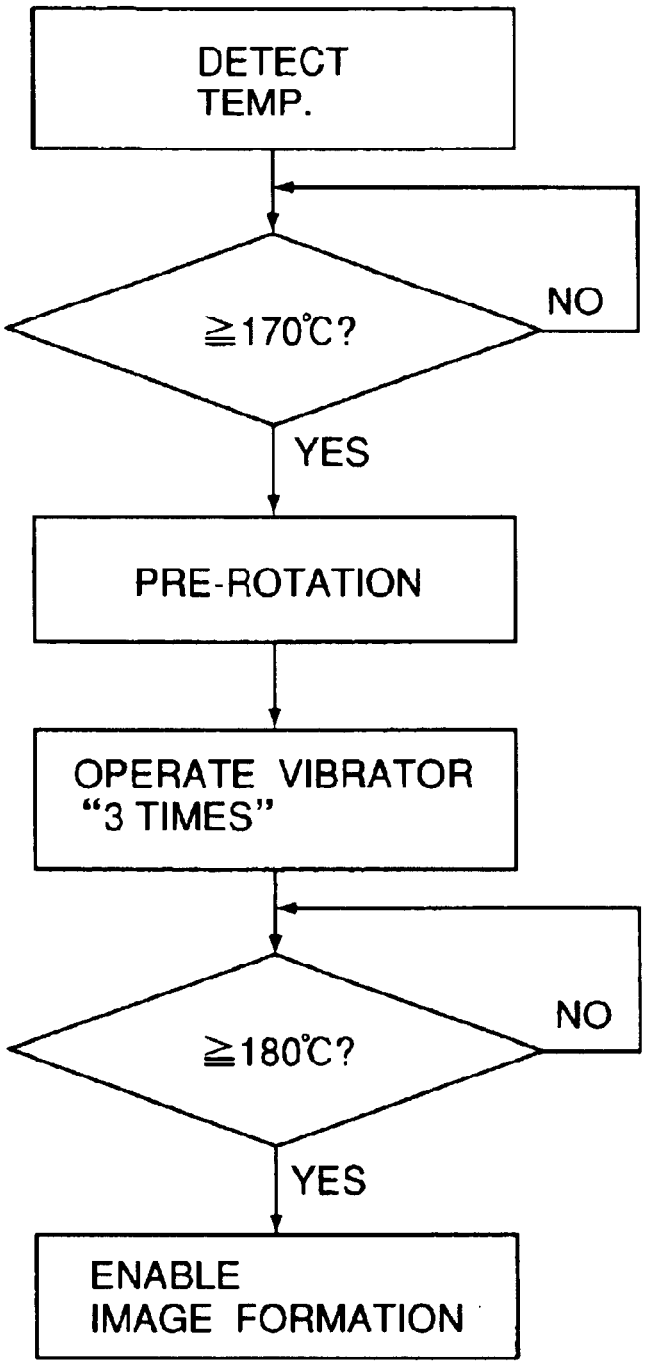
FIG. 18 is an operational flowchart for the vibration generating means carried out after the multiple photoconductive drum pre-rotations.
Figure 19:
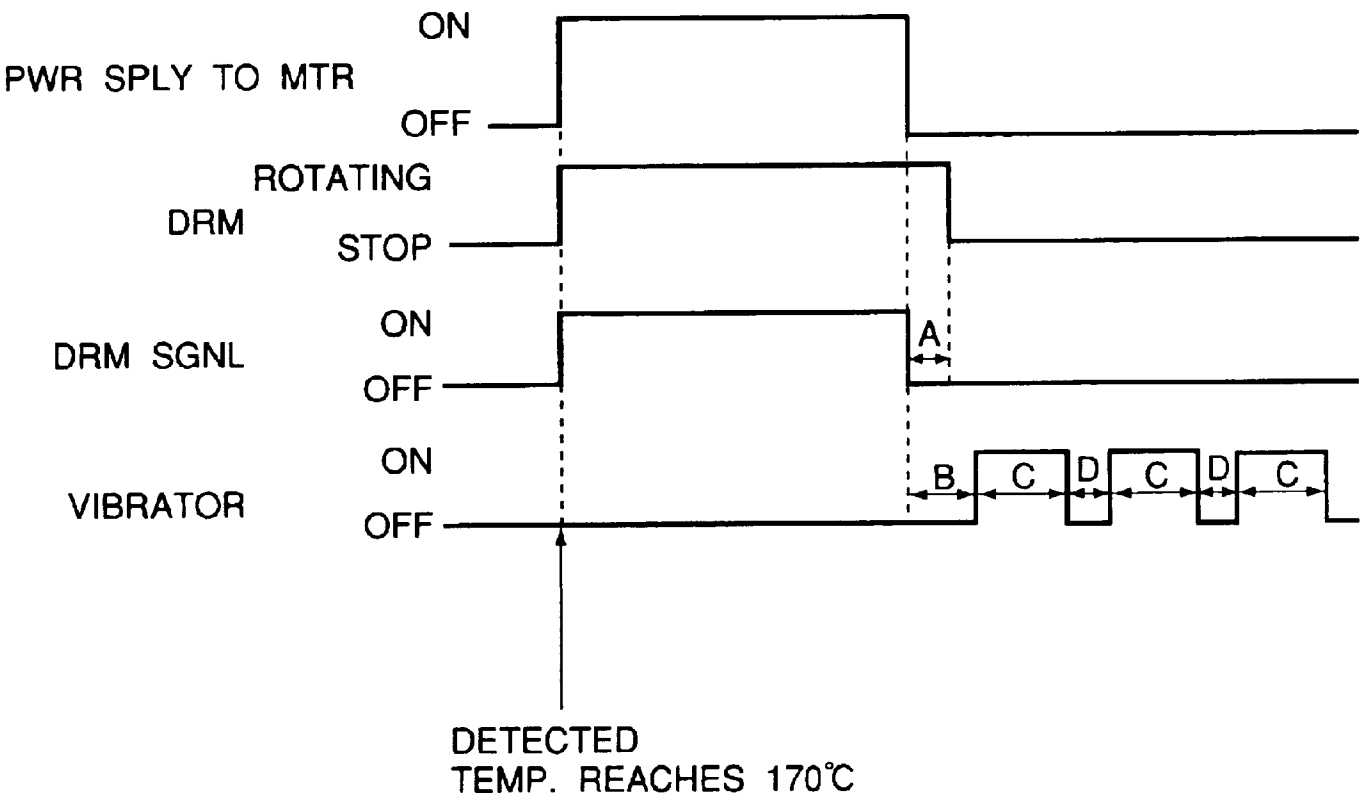
FIG. 19 is a timing chart for the vibration generating means operation carried out after the multiple photoconductive drum pre-rotations.

Referring to the flowchart in FIG. 18 and the timing chart in FIG. 19, after a drum signal for stopping the drum is issued while the drum is rotating, the power supply to the drum motor is stopped. Thus, the photoconductive drum 11 comes to a stop. However, due to inertia, it takes A seconds (predictable length of time) from the moment the power supply to the drum motor is stopped for the photoconductive drum 11 to come to a complete stop. The value of A cannot be exactly predicted because the time it takes for the rotating photoconductive drum 11 to come to a complete stop is affected by the torque necessary to rotate the photoconductive drum 11, processing speed, and the like factors, but it is usually in the range of 0.5–2. Obviously, a value other than the one in the range of 0.5–2 may be chosen, and such a choice does not affect the effectiveness of the vibration generating means.

Thus, in consideration of the inertia-driven rotation of the photoconductive drum 11, the vibration generating means 51 is activated B seconds (predetermined length of time) from the moment the drum signal is switched from ON to Off, ensuring that the vibration generating means 51 is operated when the photoconductive drum 11 is absolutely standing still.

The period C (seconds) in FIG. 19 is the period in which the vibration generating means 51 is continuously operated, and the value of C is optional In this embodiment, the vibration generating means 51 is operated for approximately 0.7 second.

The value of the B, in other words, the length of time after which the vibration generating means 51 is activated after the photoconductive drum 11 comes to a complete stop, may be set to the sum of the value of A and a value in a range of 0.1–1, for example. What value in the range of 0.1–1 should be selected depends on the type of a vibration generating means. Obviously, a value greater than a value in the range of 0.1–1 may be selected, and such selection does not affect the effectiveness of the vibration generating means 51.

The period D (seconds) is the interval between the adjacent two continuous operations of the vibration generating means 51, and the value of C is optional, as long as it is greater than zero. In this embodiment, it is approximately one second.

Further, in this embodiment, the vibration generating means is activated three times. However, the number of times the vibration generating means is activated does not need to be limited to three times.

(3-2) Before Pre-Rotation

Next, the sequence in which the vibration generating means 51 is operated prior to the multiple pre-rotations will be described.

In this sequence, the vibration generating means 51 is operated prior to the multiple pre-rotations. More specifically, the vibration generating means 51 is activated as the temperature detected by the temperature detecting means 22*c* reaches a predetermined level, for example, 150° C. Although, in this sequence, the vibration generating means 51 is activated in response to the temperature of the fixing device, the vibration generating means 51 may be activated in response to a factor other than the temperature of the fixing device. The selection of the factor other than the temperature of the fixing device does not affect the effectiveness of the operation of the vibration generating means 51 at all.

Figure 20:
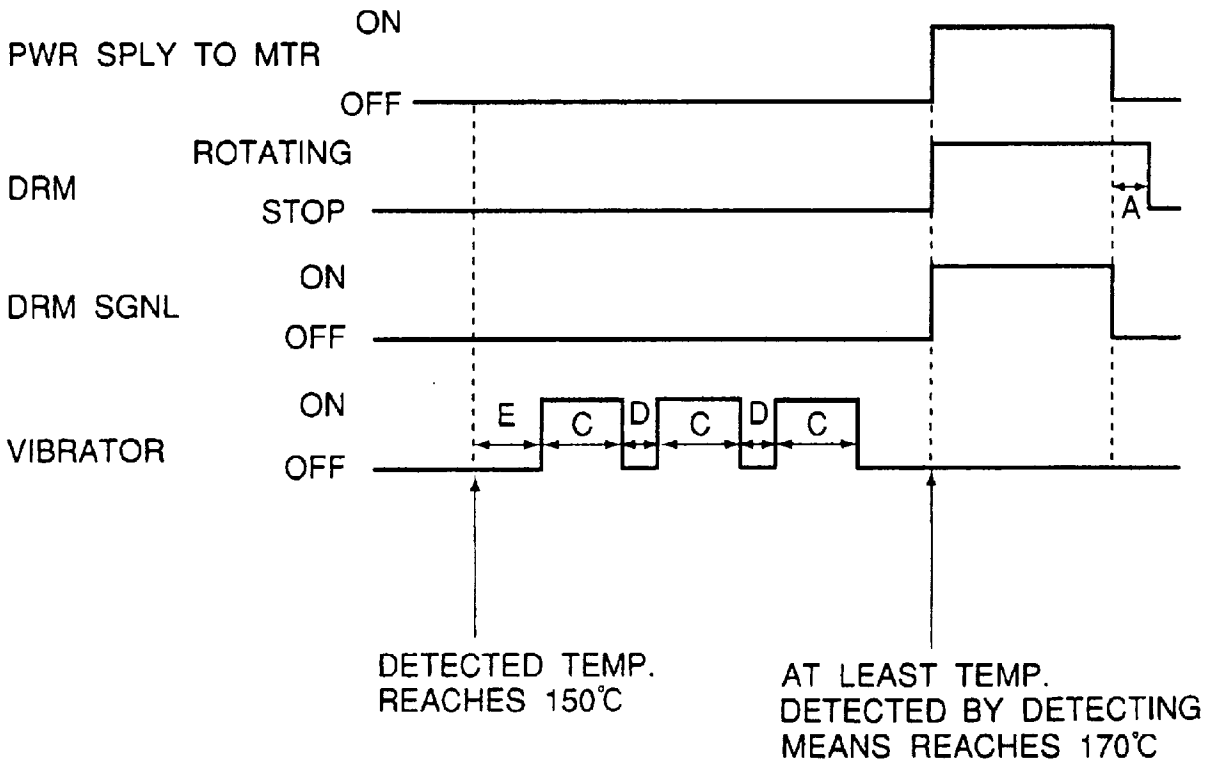
FIG. 20 is a timing chart for the vibration generating means operation carried out prior to the multiple photoconductive drum pre-rotations.

Referring to the timing chart in FIG. 20, until the temperature of the fixing device detected by the temperature detecting means 22*c* reaches 150° C., the photoconductive drum 11 is kept stationary. The vibration generating means 51 is activated E seconds after the temperature detected by the temperature detecting means 22*c* reaches 150° C. As for the value of E, it is optional and may be any value greater than zero, since there is no problem even if the vibration generating means 51 is activated at the same time as the temperature detected by the temperature detecting means 22*c* reaches 150° C. In this embodiment, it is 0.5.

The period C (seconds) in FIG. 20 is the period through which the vibration generating means 51 is continuously operated, and its value is optional In this embodiment, it is 0.7.

The period D (seconds) is the interval between the adjacent two continuous operations of the vibration generating means 51, and its value is optional as long as it is greater than zero. In this embodiment, it is approximately one.

As the temperature of the fixing device 22 detected by the temperature detecting means 22*c* reaches a predetermined level, the rotation of at least the fixing roller 22*a* and pressing roller 22*b* is started. Further, it is assumed that as the rotation of the fixing roller 22*a* and pressing roller 22*b* is started, at least the rotation (which hereinafter will be referred to as "multiple pre-rotations") of the photoconductive drum 11 is started. In this case, it is not mandatory that the multiple pre-rotations of the photoconductive drum 11 are started at the same time as the rotation of the fixing roller 22*a* and the like is started. In this embodiment, the predetermined temperature is set to 170° C.

According to this embodiment, it is possible to vibrate the cleaning blade 43 vigorously enough to remove the foreign substances adhering to the cleaning blade 43. Further, it is possible to prevent the problem that the foreign substances adhering to the cleaning blade 43 pass by the cleaning blade 43 as the vibrations reach the cleaning blade 43 Further, it is possible to satisfactorily remove the foreign substances on the peripheral surface of the photoconductive drum 11, without incurring a large cost increase.

Embodiment 11

Next, an image forming apparatus equipped with the cleaning apparatus in the eleventh embodiment will be described in detail. In this embodiment, when the vibration generating means 51 is operated twice or more times, each of the plurality of the vibration generating means operations is made different in duration from the other. The general structures of the image forming apparatus, cleaning apparatus, and vibration generating means, are the same as those in the above described first embodiment.

Operational Timing for Vibration Generating Means

Although this embodiment of the present invention will be described with reference to a case in which the vibration generating means is activated after the multiple pre-rotations, it is also compatible with a case in which the vibration generating means is activated prior to the multiple pre-rotations as it is in the first embodiment.

As the temperature of the fixing device 22 detected by the temperature detecting means 22*c* reaches a predetermined level, the rotation of at least the fixing roller 22*a* and pressing roller 22*b* is started. Further, it is assumed that as the rotation of the fixing roller 22*a* and pressing roller 22*b* is started, at least the rotation (which hereinafter will be referred to as "multiple pre-rotations") of the photoconductive drum 11 is started. In this case, it is not mandatory that the multiple pre-rotations of the photoconductive drum 11 are started at the same time as the rotation of the fixing roller 22*a* and the like is started. In this embodiment, the predetermined temperature is set to 170° C.

Referring to the timing chart in FIG. 20, after the a drum signal for stopping the drum is issued while the drum is rotating, the power supply to the drum motor is stopped. Thus, the photoconductive drum 11 comes to a stop. However, due to inertia, it takes A seconds (predictable length of time) from the moment the power supply to the drum motor is stopped, for the photoconductive drum 11 to come to a complete stop. The value of A cannot be exactly predicted because the time it takes for the rotating photoconductive drum 11 to come to a complete stop is affected by the torque necessary to rotate the photoconductive drum 11, processing speed, and the like factors, but it is usually in the range of 0.5–2. Obviously, a value other than the one in the range of 0.5–2 may be chosen, and such a choice does not affect the effectiveness of the vibration generating means at all.

Thus, in consideration of the inertia-driven rotation of the photoconductive drum 11, the vibration generating means 51 is activated B seconds (predetermined length of time) from the moment the drum signal is switched from ON to Off, ensuring that the vibration generating means 51 is operated when the photoconductive drum 11 is absolutely standing still.

Figure 21:
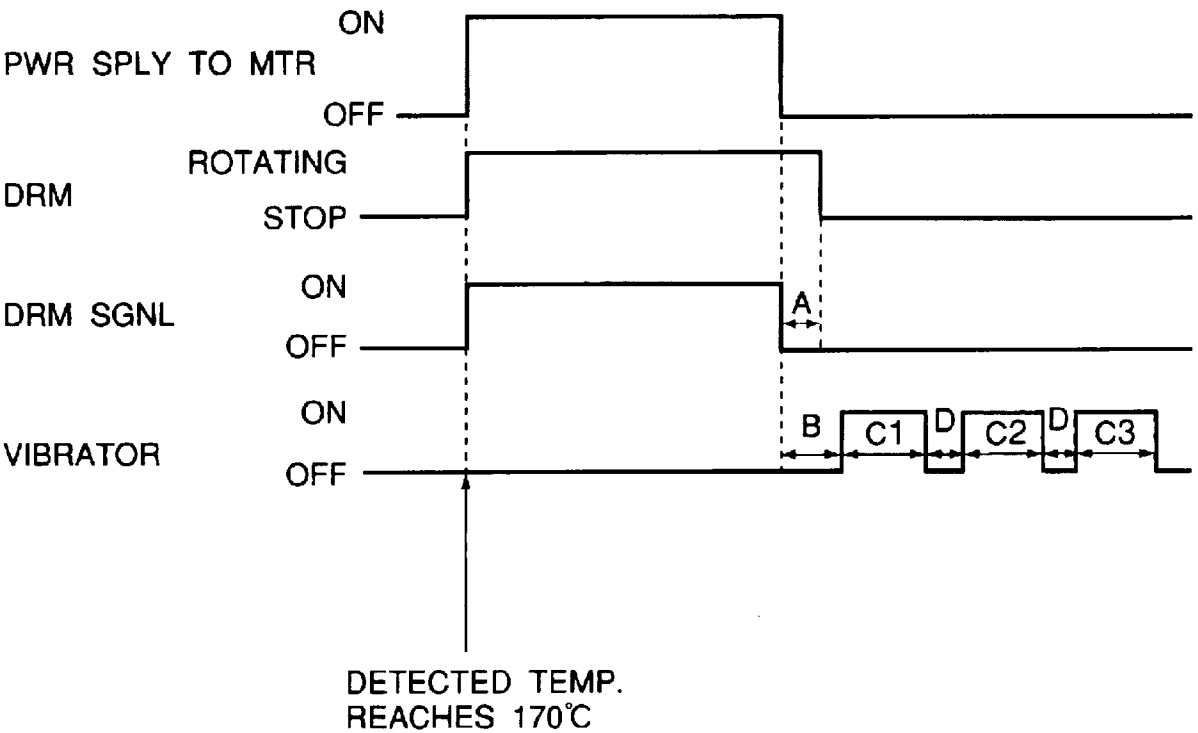
FIG. 21 is another timing chart for the vibration generating means operation carried out after the multiple photoconductive drum pre-rotations.

The periods C1–C2 (seconds) in FIG. 21 are the periods through which the vibration generating means 51 is continuously operated, and their values are optional. In this embodiment, the lengths of the periods C1–C3 were approximately 0.7, 0.8, and 0.9 second, respectively.

The durations of these operational periods may be optionally set in consideration of the operation of the image forming apparatus itself.

The value of B, in other words, the length of time after which the vibration generating means 51 is activated after the photoconductive drum 11 comes to a complete stop, may be set to the sum of the value of A and a value in the range of 0.1–1, for example. What value in the range of 0.1–1 should be selected depends on the type of a vibration generating means Obviously, a value greater than a value in the range of 0.1–1 may be selected, and such selection does not affect the effectiveness of the vibration generating means 51.

The period D (seconds) is the interval between the adjacent two continuous operations of the vibration generating means 51, and its value is optional as long as it is greater than zero. In this embodiment, the duration of the period D is approximately one second.

In this embodiment, a case in which the vibration generating means 51 is activated twice or more before the multiple pre-rotations of the photoconductive drum 11, and in which the duration of each operation is made different from those of the others, is described. However, the application of this embodiment does not need to be limited to this case. For example, the operational sequence may be such that the vibration generating means 51 is operated twice or more after the multiple pre-rotations of the photoconductive drum 11 as was in the first embodiment, and that each operation is made different in duration from the others. Obviously, such an operational sequence also provides the same effects as those obtained following the operational sequence in this embodiment.

According to this embodiment, it is possible to vibrate the cleaning blade 43 vigorously enough to remove the foreign substances adhering to the cleaning blade 43. Further, it is possible to prevent the problem that the foreign substances adhering to the cleaning blade 43 pass by the cleaning blade 43 as the vibrations reach the cleaning blade 43. Further, it is possible to satisfactorily remove the foreign substances on the peripheral surface of the photoconductive drum 11, without incurring a large cost increase.

Embodiment 12

Next, an image forming apparatus equipped with the cleaning apparatus in this twelfth embodiment of the present invention will be described in detail. In this embodiment, how many times the vibration generating means 51 is activated is determined according to the temperature of the fixing device detected by the temperature detecting means 22*c*, and then, the vibration generating means 51 is operated the determined number of times after or before the multiple pre-rotations of the photoconductive drum 11. The general structures of the image forming apparatus, cleaning apparatus, and vibration generating means, are the same as those in the above described first embodiment.

Figure 22:
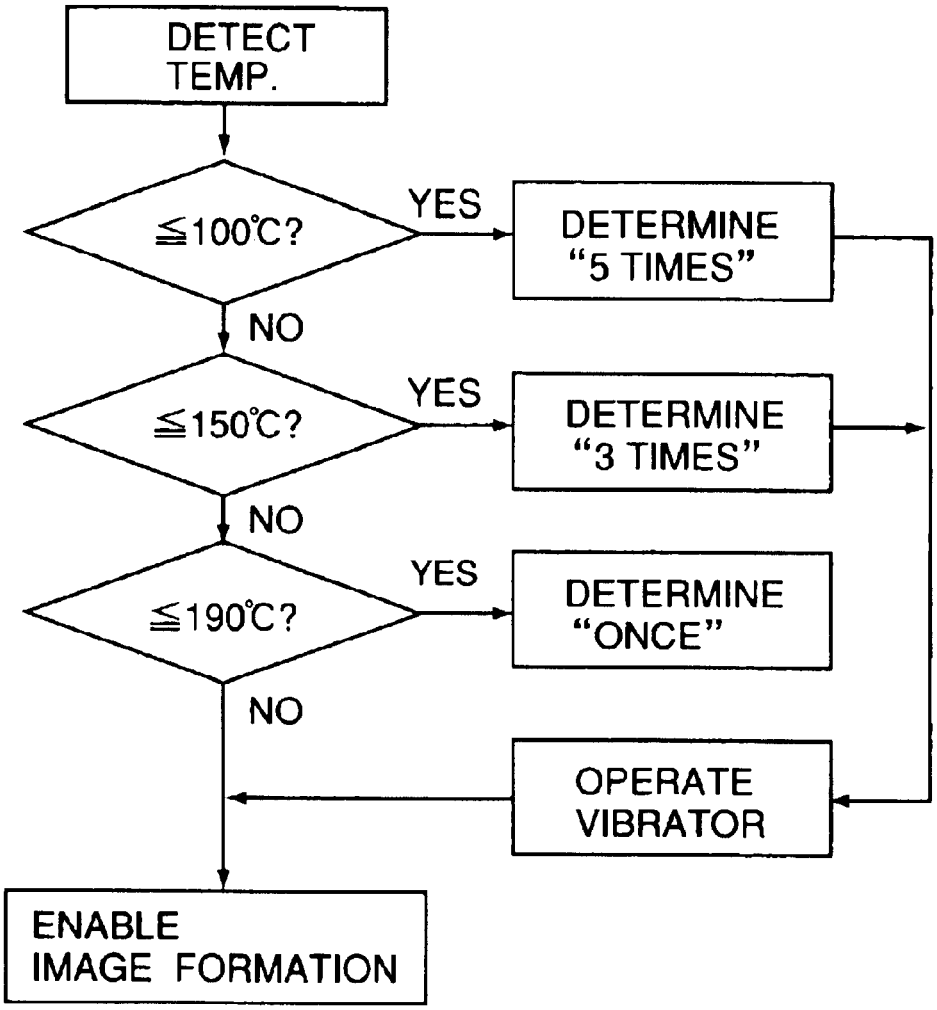
FIG. 22 is a flowchart for determining how many times the vibration generating means should be activated based on the fixing device temperature.

Method for Determining Number of Times Vibration Generating Means is to be Activated FIG. 22 shows the flowchart for determining how many times the vibration generating means is to be activated.

First, the temperature of the fixing device 22*c* is detected by the temperature detecting means 22*c* at a predetermined moment in an image forming operation. The predetermined moment in this case is when the power to an image forming apparatus is turned on, when the image forming apparatus has just recovered from the standby condition, when the image forming apparatus has just recovered from the paper jam or the like which occurred in the recording medium conveyance path, when the image forming apparatus has just recovered from the errors, or the like moment in an image forming operation. Assuming that the temperature of the fixing device is detected at the predetermined moment in an image forming operation, for example, one of the above described moments, if the detected temperature is no higher than 100° C., the vibration generating means 51 is activated five times; if it is in the range of 100° C.–150° C., the vibration generating means 51 is activated three times; if it is in the range of 150° C.–190° C., the vibration generating means 51 is activated once; and if it is no lower than 190° C., the vibration generating means 51 is not activated at all. In this embodiment, the temperature of the fixing device 22 during image formation is 200° C. It becomes possible to form images after the vibration generating means 51 is activated the determined number of times. The temperature at which the vibration generating means 51 is activated, and the number of times the vibration generating means 51 is activated, mentioned in this embodiment, are only examples of such temperature and number of times. Obviously, they may be set to values different from the aforementioned ones.

Operational Timing for Vibration Generating Means

The moment in an image forming operation at which the vibration generating means 51 is activated may be after or prior to the multiple pre-rotations, as in the tenth or eleventh embodiment, respectively.

According to this embodiment, the number of times the vibration generating means 51 is to be activated can be minimized, making it possible for the vibration generating means 51 to last longer.

Embodiment 13

In this embodiment, the operation of the vibration generating means, which is to be carried out while the heating means for heating an image bearing member is operating, is carried out while the image bearing member is stationary.

In an environment other than a low humidity environment in which the temperature and humidity are 25° C. and 50%, respectively, the moisture which contains the byproduct of image formation, for example, ozone, sometimes adheres to the photoconductive drum because of high humidity, causing some portions of the peripheral surface of the photoconductive drum to fail to be charged. As for the countermeasure for such a problem, the moisture on the peripheral surface of the photoconductive drum may be evaporated by heating the photoconductive drum by an image bearing member heating means. Further, if a cleaning blade, which performs best when the ambient temperature is approximately 30° C., is used in an environment with the normal temperature, for example, 23° C., the cleaning blade sometimes fails to display its full performance during the initial stage of a cleaning operation. Thus, it is considered to heat a photoconductive drum.

However, when the photoconductive drum temperature is high, the toner particles in the adjacencies of the cleaning blade edge are likely to agglomerate, because the higher the temperature, the more likely they melt, and therefore, the more easily they agglutinate. Further, in recent years, toners with a lower melting point have come to be used to reduce energy consumption, and therefore, the above described problem has become more noticeable. On the other hand, the lower the humidity, the more likely toner particles are to agglomerate. The reason for this is thought to be that the lower the humidity, the stronger the electrostatic attraction between the adjacent two toner particles.

Heating Means

Figure 23:
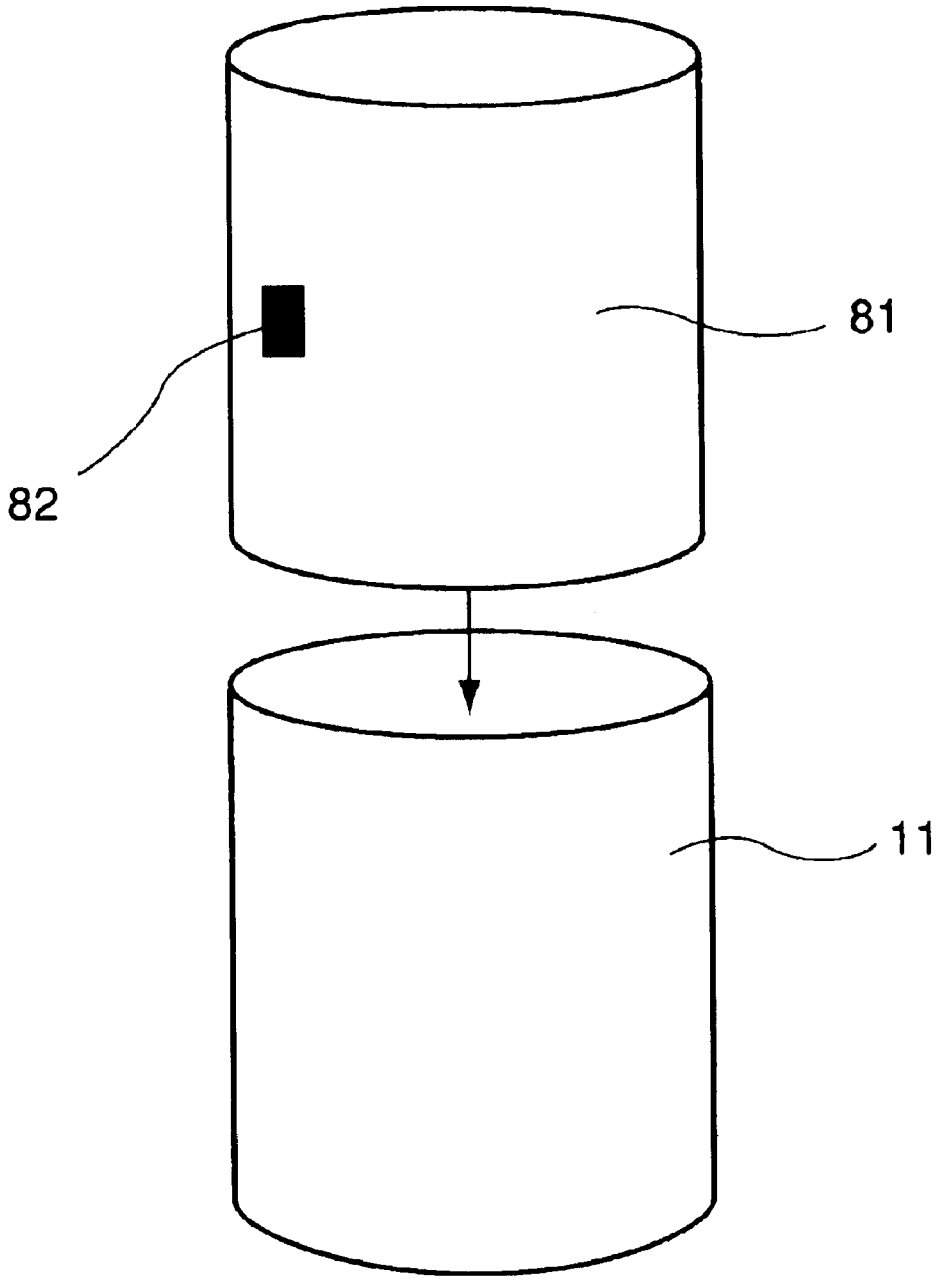
FIG. 23 is a perspective view of the heating means for heating an image bearing member.

FIG. 23 shows a heating means 81. The heating means 81 in this embodiment primarily heats the photoconductive drum 11, and controls the temperature of the photoconductive drum 11 detected by a temperature detecting means 82. In this embodiment, the temperature level around which the temperature of the photoconductive drum 11 is kept is 40° C. The heating means 81 in this embodiment is a cylindrical heating member, for example, which fits in the hollow of the photoconductive drum 11 in a manner to cover the internal surface of the photoconductive drum 11. Obviously, the heating means 81 may be of a type different from the cylindrical type.

Operational Timing for Photoconductive Drum Heating Means

First, an example of an operation of the photoconductive drum heating means in this embodiment will be described. As described before, in an environment other than the environment in which humidity is low, such moisture that contains the byproducts of image formation, for example, ozone, sometimes adheres to a photoconductive drum because of high humidity, creating the problem that some parts of the photoconductive drum fail to be charted for image formation, and therefore, it is necessary, as a countermeasure for the problem, to heat the photoconductive drum to evaporate the moisture on the photoconductive drum. Thus, experiments for determining the threshold humidity level were carried out, revealing that when humidity was no more than 20%, the above described problem did not occur, whereas when humidity was no less than 20%, the problem occurred. Therefore, when humidity is no less than 20%, it is necessary to turn on the heating means.

Thus, when the humidity detected by the humidity detecting means 72 shown in FIG. 12 is no less than 20%, the heating means 81 for heating the photoconductive drum 11 is turned on as long as the power is supplied to the image forming apparatus main assembly; not only is the heating means 81 turned on while an image is formed, but also while no image is formed.

Next, another situation in which the heating means needs to be activated will be described. As the ambient temperature decreases, the elasticity of the cleaning blade also decreases. Thus, if the main power to an image forming apparatus is turned on when the ambient temperature was low, the cleaning blade fails to display its full performance. Further, the greater the process speed, the more conspicuous this problem. Thus, the heating means 81 is activated when the temperature detected by the temperature detecting means 71 shown in FIG. 12 is no more than the so-called normal temperature, that is, 23° C.

There is another situation in which the heating means 81 should be activated. That is, as a plurality of images are continuously formed in a single-sided mode, a cleaning blade sometimes fails to display its full performance for the following reason. That is, since the temperature of the transfer medium is normal, the temperature of the photoconductive drum remains normal, which in turn keeps the temperature of the cleaning blade at a level lower than the level at which the cleaning blade performs best. Therefore, when a plurality of transfer mediums are continuously fed, the heating means 81 is activated.

While the main assembly of an image forming apparatus is not on, the heating means 81 can be turned on or off in the service mode. When the control of the heating means 81 is set in the service mode, the heating means 81 is always kept in the ON state while the power to the apparatus main assembly is not on.

The above described situations in which the heating means 81 is activated are only a few examples of the situations in which the heating means 81 should be activated with preferable results; the heating means 81 may be activated when necessary.

In this embodiment, a structural arrangement is made so that when the heating means 81 is in action, the vibration generating means 51 is activated, based on the timing, which will be described later, to prevent toner particles from agglomerating in the adjacencies of the cleaning blade.

Timing

Next, the operational timing for the vibration generating means 51 will be described.

In this embodiment, in the case that the vibrations are to be generated by the vibration generating means while the image bearing member heating means is operating, the vibration generating means is operated while the image bearing member is kept stationary.

As the examples of the timings in this embodiment, those listed in the description of the first embodiment can be listed: (1) when an image forming apparatus is activated for the first time for the day (sequence shown in FIG. 6), (2) when an image forming operation is interrupted to operate the vibration generating means (sequence shown in FIG. 7), and (3) when an image forming operation is interrupted to clean the wire of a corona-type charging means (sequence shown in FIG. 8). The portions of the descriptions of these sequences which overlap with those already given will be discretionarily omitted here.

The situation in which the vibration generating means is operated with the timings (1) is while the heating means 81 has been kept on during the night, or while vibration generating means is operated immediately after the image forming apparatus is turned on.

The situation in which the vibration generating means is operated with the timing (2) is while the heating means 81 is always kept on during a continuous image forming operation, or while the heating means 81 is kept on during a part or parts of a continuous image forming operation.

The situation in which the vibration generating means is operated with the timing (3) is while the heating means 81 is operating during an image forming operation, or while the heating means 81 is kept on during a part or parts of a continuous image forming operation.

As described above, according to this embodiment, the vibration generating means 51 is operated only when the ambient temperature requires. Therefore, the vibration generating means 51 lasts longer while maintaining the proper level of image quality.

Embodiment 14

Next, an image forming apparatus equipped with the cleaning apparatus in the fourteenth embodiment of the present invention will be described in detail. The general structures of the image forming apparatus, cleaning apparatus, and vibration generating means, are the same as those in the above described first embodiment.

This embodiment relates to the sequence carried out by the vibration generating means when the photoconductive drum heating means is activated while the image forming apparatus is not on. Generally, the longer the time an image forming apparatus is kept undisturbed, in other words, the longer the time the power to the image forming apparatus is not turned on, the greater the adhesion of the agglomeration of toner particles to the cleaning blade and its adjacencies.

This embodiment is for efficiently removing the toner particle agglomeration in such a situation.

Thus, in this embodiment, the vibration generating means is operated twice or more when the following conditions exist: the heating means 81 has been operating throughout the night, or the image forming apparatus has just been turned on for the first time for the day; and the temperature of the fixing device is lower than a predetermined level.

The fixing apparatus in this embodiment is the same as those in the preceding embodiments, described with reference to FIG. 17. It is assumed that during an image forming operation, the temperature of the fixing roller is 200° C., and that when the detected temperature of the fixing roller is no more than 170° C., it is determined that the image forming apparatus has been turned on for the first time for the day.

The temperature value of the fixing device, based on which whether or not the vibration generating means is to be operated is determined, is affected by the image forming apparatus structure, therefore being impossible to set exactly; it may he different from the value set in this embodiment, and the selection, of a value different from the value set in this embodiment does not change the effectiveness of the vibration generating means.

Operational Timing for Vibration Generating Means (1) After Multiple Pre-rotations Next, a sequence in which the vibration generating means 51 is operated after the multiple pre-rotations will be described.

As the temperature of the fixing device 22 detected by the temperature detecting means 22*c* reaches a predetermined level, the rotation of at least the fixing roller 22*a* and pressing roller 22*b* is started. Further, it is assumed that as the rotation of the fixing roller 22*a* and pressing roller 22*b* is started, at least the rotation (which hereinafter will be referred to as multiple pre-rotations) of the photoconductive drum 11 is started. In this case, it is not mandatory that the multiple pre-rotations of the photoconductive drum 11 are started at the same time as the rotation of the fixing roller 22*a* and the like is started. In this embodiment, the predetermined temperature is set to 170° C.

Referring to the timing chart in FIG. 19, after the drum signal for stopping the drum is issued while the drum is rotating, the power supply to the drum motor is stopped. Thus, the photoconductive drum 11 comes to a stop. However, due to inertia, it takes A seconds (predictable length of time) from the moment the power supply to the drum motor is stopped, for the photoconductive drum 11 to come to a complete stop. The value of A cannot be exactly predicted because the time it takes for the rotating photoconductive drum 11 to come to a complete stop is affected by the torque necessary to rotate the photoconductive drum 11, processing speed, and the like factors, but it is usually in the range of 0.5–2. Obviously, a value other than the one in the range of 0.5–2 may be chosen, and such a choice does not affect the effectiveness of the vibration generating means.

Thus, in consideration of the inertia-driven rotation of the photoconductive drum 11, the vibration generating means 51 is activated B seconds (predetermined length of time) from the moment the drum signal is switched from ON to Off, ensuring that the vibration generating means 51 is operated when the photoconductive drum 11 is absolutely standing still.

The period C (seconds) in FIG. 19 is the period through which the vibration generating means 51 is continuously operated, and the value of C is optional. In this embodiment, the vibration generating means 51 is operated for approximately 0.7 second.

The value of the B, in other words, the length of time after which the vibration generating means 51 is activated after the photoconductive drum 11 comes to a complete stop, may be set to the sum of the value of A and a value in a range of 0.1–1, for example. What value in the range of 0.1–1 should be selected depends on the type of a vibration generating means. Obviously, a value greater than a value in the range of 0.1–1 may be selected, and such selection does not affect the effectiveness of the vibration generating means 51.

The period D (seconds) is the interval between the adjacent two continuous operations of the vibration generating means 51, and the value of D is optional, as long as it is greater than zero. In this embodiment, it is approximately one second.

(2) Before Multiple Pre-rotations

Next, the sequence in which the vibration generating means 51 is operated before the multiple pre-rotations will be described.

In the case of this sequence, the vibration generating means 51 is operated before the multiple pre-rotations of the photoconductive drum, and it is activated as the temperature detected by the temperature detecting means 22*c* reaches a predetermined level, for example, 150° C. Also in this sequence, the temperature of the fixing device is used as the factor based on which the vibration generating means 51 is activated. However, the signal based on a factor other than temperature may be used to activate the vibration generating means 51 with a predetermined timing, and the usage of such a signal does not affect the effectiveness of the operation of the vibration generating means 51 at all.

Referring to the timing chart in FIG. 20, until the temperature of the fixing device 22 detected by the temperature detecting means 22*c* reaches 170° C., the photoconductive drum 11 is kept stationary. The vibration generating means 51 is activated E seconds after the temperature detected by the temperature detecting means 22*c* reaches 150° C. As for the value of E, it is optional and may be any value greater than zero, since there is no problem even if the vibration generating means 51 is activated at the same time as the temperature detected by the temperature detecting means 22*c* reaches 150° C. In this embodiment, it is 0.5.

The period C (seconds) in FIG. 20 is the period through which the vibration generating means 51 is continuously operated, and its value is optional. In this embodiment, it is 0.7.

The period D (seconds) is the interval between the adjacent two continuous operations of the vibration generating means 51, and its value is optional as long as it is greater than zero. In this embodiment, it is approximately one. No matter what value is chosen, the effects of the operation of the vibration generating means 51 do not change.

According to this embodiment, the vibration generating means 51 is enabled to generate a sufficient amount of vibrations, in addition to the amount in the first embodiment, for removing the foreign substances adhering to the cleaning blade 43. Further, it is possible to prevent the problem that the foreign substances adhering to the cleaning blade 43 pass by the cleaning blade 43 as the vibrations reach the cleaning blade 43. Further, it is possible to satisfactorily remove the foreign substances on the peripheral surface of the photoconductive drum 11, without incurring a large cost increase.

Embodiment 15

Next, an image forming apparatus equipped with the cleaning apparatus in the fifteenth embodiment of the present invention will be described in detail. The general structures of the image forming apparatus, cleaning apparatus, and vibration generating means, are the same as those in the above described first embodiment.

In this embodiment, how many times the vibration generating means 51 is to be activated immediately after the image forming apparatus is activated for the first time for the day while the heating means 81 has been kept on is controlled based on the state of the fixing device 22.

In other words, when the vibration generating means 51 is activated while the heating means 81 is on, how many times the vibration generating means 51 is to be activated is determined based on the temperature of the fixing device 22 detected by the temperature detecting means 22*c*; the vibration generating means 51 is activated the thus determined number of times.

Method for Determining Number of Times Vibration Generating Means is to be Activated FIG. 22 shows the flowchart for determining the number of times the vibration generating means 51 should be activated.

The temperature of the fixing device 22 is detected by the temperature detecting means 22*c* at a predetermined moment in an image forming operation. An example of the predetermined moment is: the moment an image forming apparatus is turned on for the first time for the day; the moment an image forming apparatus has just recovered from the standby condition; the moment an image forming apparatus has just recovered from a paper jam which had occurred in the conveying portion of the like; and the moment an image forming apparatus has just recovered from an operational error. If the temperature of the fixing device 22 detected by the temperature detecting means 22*c* at one of these moments is no higher than 150° C., the vibration generating means 51 is activated five times, and if it is no higher than 170° C., the vibration generating means 51 is activated three times. If it is no higher than 180° C., the vibration generating means 51 is activated once, whereas if it is no lower than 180° C., the vibration generating means 51 is not activated. The temperatures and vibration generating means activation counts given above are just the examples; values different from those given above may be chosen, and such choices do not affect the effectiveness of the vibration generating means 51.

Operational Timing for Vibration Generating Means

The operational sequence repeated the determined number of times by the vibration generating member in this embodiment structured as described above is the same as that in the fourteenth embodiment.

With the provision of the above described structural arrangement, the vibration generating means can be more efficiently operated, and not only is it possible obtain the effects similar to those obtained in the preceding embodiments, but also it is possible to make the vibration generating means last longer Miscellanies Although in the preceding embodiments, the present invention was described with reference to an image forming apparatus capable of forming monochromatic images, the application of the present invention is not limited to such an image forming apparatus; the present invention is also applicable, with the same results, to the cleaning apparatus of an image forming apparatus capable of forming color images.

Also in the preceding embodiments, the image forming apparatus was described as a copying machine. But, the application of the present invention is not limited to a copying machine. In other words, the present invention is applicable to various image forming apparatuses other than a copying machine, for example, a printer, a facsimile machine, or a multifunctional image forming machine, that is, a combination of a printer and a facsimile machine. As for the type of the image fanning apparatus structure, the present invention is applicable to an image forming apparatus which employs a transfer/conveyance belt as a transfer medium bearing member, and in which a plurality of toner images different in color are sequentially transferred in layers onto a transfer medium, such as a sheet of paper, borne on the transfer/conveyance belt, or an image forming apparatus which employs an intermediary transferring member, and in which the toner images sequentially formed on the image bearing member are temporarily transferred onto the intermediary transferring member as they are formed, and then, are transferred all at once onto a transfer medium from the intermediary transferring member. When the present invention is applied to the cleaning apparatus of any of the above listed image forming apparatuses, the same effects as those described above can be obtained.

Further, in the preceding embodiments, the object to be cleaned was the rotational image bearing member (photoconductive drum) of an image forming apparatus, and the present invention was described with reference to the cleaning apparatus for removing the foreign substance adhering to the photoconductive drum. However, the application of the present invention is not limited to such a cleaning apparatus. For example, the present invention is also applicable, with the same results, to a cleaning apparatus for removing the foreign substances adhering to an object other than a photoconductive drum, for example, the aforementioned transfer medium bearing member or intermediary transferring member.

Effects of Invention

As described above, according to the present invention, it is possible to shake down the agglomeration of foreign substances adhering to a cleaning member and the adjacencies of the contact portion between a cleaning member and an object to be cleaned by the cleaning member, without incurring a large amount of cost increase, and also to prevent the problem that the object to be cleaned fails to be properly cleaned because the above described foreign substances pass by the cleaning member.

Further, according to the present invention, it is possible to prevent the formation of images with defects traceable to the transfer medium contamination resulting from improper cleaning.

While the invention has been described with reference to the structures disclosed herein, it is not confined to the details set forth, and this application is intended to cover such modifications or changes as may come within the purposes of the improvements or the scope of the following claims.

What is claimed is:

1. A cleaning device comprising:

a cleaning member for cleaning a member to be cleaned;

vibration imparting means for imparting vibration to said cleaning member; and control means for controlling said vibration imparting means, wherein said control means intermittently actuates said vibration imparting means a plurality of times in one cleaning step.

2. A device according to claim 1, wherein a time interval in the intermittent actuation of said vibration imparting means is at least a time period until a vibration of said cleaning member dissipates.

3. A device according to claim 1, wherein said member to be cleaned is an image bearing member carrying a toner image on a surface, and said cleaning member is effective to clean the surface of said image bearing member.

4. A device according to claim 1, wherein an acceleration of said cleaning member or a holding member for holding said cleaning member when said vibration imparting means is in operation is not less than 10 m/sec$^2$ and less than 1000 m/sec$^2$.

5. A device according to claim 1, wherein said vibration imparting means includes a vibration member which vibrates by electric power supply thereto, wherein said cleaning member or a holding member for holding said cleaning member supports said vibration member, by which said vibration member vibrates said cleaning member.

6. A cleaning device comprising:

a cleaning member for cleaning a member to be cleaned;

vibration imparting means for imparting vibration to said cleaning member;

control means for controlling said vibration imparting means; and detecting means for detecting at least one of an ambient temperature and humidity, wherein said control means controls said vibration imparting means in accordance with a result of detection of said detecting means.

7. A device according to claim 6, wherein said control means determines whether to actuate said vibration imparting means on the basis of the result of detection of said detecting means.

8. A device according to claim 7, wherein said control means, when said detecting means detects a temperature which is higher than a predetermined level, actuates said vibration imparting means, and said control means, when said detecting means detects a temperature which is lower than the predetermined level, does not actuate said vibration imparting means.

9. A device according to claim 7, wherein said control means, when said detecting means detects a humidity which is lower than a predetermined humidity level, actuates said vibration imparting means, and said control means, when said detecting means detects a humidity which is higher than the predetermined level, does not actuate said vibration imparting means.

10. A device according to claim 6, wherein said control means determines a number of times of actuations of said vibration imparting means on the basis of the result of detection of said detecting means.

11. A device according to claim 10, wherein said control means actuates said vibration imparting means a number of times which is larger when the result of detection indicates a higher temperature.

12. A device according to claim 10, wherein said control means actuates said vibration imparting means a number of times which is larger when the result of detection indicates a lower humidity.

13. An image forming apparatus comprising:

an image bearing member for bearing a toner image on a surface thereof;

a cleaning member for removing the toner from the surface of said image bearing member;

vibration imparting means for imparting vibration to said cleaning member; and control means for controlling said vibration imparting means, wherein said control means intermittently actuates said vibration imparting means a plurality of times in one cleaning step.

14. An image forming apparatus comprising:

an image bearing member;

a cleaning member for removing toner from the surface of said image bearing member;

vibration imparting means for imparting vibration to said cleaning member;

control means for controlling said vibration imparting means in response to actuation of a main switch of a main assembly of the image forming apparatus;

transferring means for transferring an image from said image bearing member onto a transfer material;

fixing means for fixing an image on the transfer material; and fixing temperature detecting means for detecting a temperature of said fixing means, wherein said control means controls said vibration imparting means in accordance with a result of detection of said fixing temperature detecting means.

15. An apparatus according to claim 14, wherein said control means determines a number of times of actuations of said vibration imparting means on the basis of the result of detection of said fixing temperature detecting means.

16. An apparatus according to claim 15, wherein said control means actuates said vibration imparting means a number of times which is larger when the result of detection indicates a lower temperature.

17. An apparatus according to claim 14, wherein said control means determines whether to actuate said vibration imparting means depending on a result of detection of said fixing temperature detecting means.

18. An apparatus according to claim 17, wherein said control means actuates said vibration imparting means when said fixing temperature detecting means detects a temperature which is lower than a predetermined level, and does not actuate said vibration imparting means when said fixing temperature detecting means detects a temperature which is higher than the predetermined level.

19. An image forming apparatus comprising:

an image bearing member;

a cleaning member for removing toner from the surface of said image bearing member;

vibration imparting means for imparting vibration to said cleaning member;

control means for controlling said vibration imparting means; and heating means for heating said image bearing member, wherein said control means effects operation of said vibration imparting means for a duration of said heating means being in operation, when said image bearing member is at rest.

* * * * *

UNITED STATES PATENT AND TRADEMARK OFFICE

CERTIFICATE OF CORRECTION

PATENT NO. : 6,801,747 B2
DATED : October 5, 2004
INVENTOR(S) : Keizo Ogara et al.

It is certified that error appears in the above-identified patent and that said Letters Patent is hereby corrected as shown below:

Column 1,
Line 28, “drum” should read -- drum. --.

Column 4,
Line 30, “1” should read -- 1. --.

Column 11,
Line 21, “the B,” should read -- B, --.

Column 12,
Line 55, “the B,” should read -- B, --.

Column 14,
Line 30, “defect” should read -- defect. --.

Column 16,
Line 61, “4%” should read -- 4%. --.

Column 19,
Line 25, “51” should read -- 51. --; and
Line 31, “obvious” should read -- obvious. --.

Column 21,
Line 8, “optional” should read -- optional. --;
Line 11, “the B,” should read -- B, --; and
Line 59, “optional” should read -- optional. --.

Column 22,
Line 15,”blade 43” should read -- blade 43. --.

Column 23,
Line 17, “means” should read -- means. --.

Column 28,
Lint 1, “the B,” should read -- B, --.

UNITED STATES PATENT AND TRADEMARK OFFICE

CERTIFICATE OF CORRECTION

PATENT NO. : 6,801,747 B2
DATED : October 5, 2004
INVENTOR(S) : Keizo Ogara et al.

It is certified that error appears in the above-identified patent and that said Letters Patent is hereby corrected as shown below:

Column 29,
Line 51, “longer” should read -- longer. --.

Signed and Sealed this

First Day of February, 2005

JON W. DUDAS
*Director of the United States Patent and Trademark Office*